US005809391A

United States Patent [19]

Fujita et al.

[11] Patent Number: 5,809,391

[45] Date of Patent: Sep. 15, 1998

[54] IMAGE FORMING APPARATUS ENABLING EASY AND RELIABLE RECOVERY FROM A POP JAM

[75] Inventors: Tetsuya Fujita; Satoru Torimaru; Fumio Furusawa; Keiji Yamamoto; Masaaki Tokunaga; Hitoshi Funato; Satoshi Fukada, all of Ebina, Japan

[73] Assignee: Fuji Xerox Co., Ltd., Tokyo, Japan

[21] Appl. No.: 715,467

[22] Filed: Sep. 18, 1996

[30] Foreign Application Priority Data

| | | | |
|---|---|---|---|
| Sep. 19, 1995 | [JP] | Japan | 7-240230 |
| Sep. 20, 1995 | [JP] | Japan | 7-241028 |
| Nov. 24, 1995 | [JP] | Japan | 7-306061 |

[51] Int. Cl.[6] ..... G03G 15/00

[52] U.S. Cl. ..... 399/396; 399/18

[58] Field of Search ..... 399/16, 18, 301, 399/388, 394, 396; 271/256, 258.01, 259, 258.03

[56] References Cited

U.S. PATENT DOCUMENTS

| | | | |
|---|---|---|---|
| 4,231,567 | 11/1980 | Ziehm | 271/259 |
| 5,058,879 | 10/1991 | Dunaway | 271/259 |
| 5,136,342 | 8/1992 | Ida et al. | 399/396 |
| 5,316,289 | 5/1994 | Matsuo | 271/258.03 |
| 5,485,247 | 1/1996 | Morishita et al. | 399/16 |

FOREIGN PATENT DOCUMENTS

| | | |
|---|---|---|
| 3-75757 | 3/1991 | Japan . |
| 6-24607 | 2/1994 | Japan . |
| A-8-171293 | 7/1996 | Japan . |

*Primary Examiner*—Sandra L. Brase
*Attorney, Agent, or Firm*—Oliff & Berridge, PLC.

[57] ABSTRACT

An image forming apparatus includes a sheet transport channel including a registration roller for supplying a sheet that is fed from a tray to an image recording section at predetermined timing. A brake forcibly stops rotation of the registration roller. A sensor senses the occurrence of an abnormality in the paper transport channel during transport of the sheet. A controller activates the brake when the sensor has detected the abnormality. Therefore, when a POP jam occurs, sheet rushing into the cleaner due to an overrun can be reliably prevented. Also, in the case of feeding a sheet to prevent a guillotine jam, sheet rushing into the image recording section due to idle rotation of the registration roller can be prevented reliably.

3 Claims, 20 Drawing Sheets

IMAGE FORMING APPARATUS ENABLING EASY AND RELIABLE RECOVERY FROM A POP JAM

BACKGROUND OF THE INVENTION

1. Field of the Invention

This invention relates to a mechanism for effecting recovery from a paper jam caused by a recording sheet sticking to an image carrying body such as a photoreceptor drum when a toner image formed on the image carrying body is transferred to the recording sheet in an image forming apparatus such as a copier or a laser printer.

2. Description of the Related Art

As one type of paper jam occurring when an image forming apparatus such as a copier is operating, there is a so-called POP jam (paper on the photoreceptor jam) in which a recording sheet is stuck to an image carrying body when a toner image formed on the image carrying body is transferred to the recording sheet.

Conventionally, a small black-and-white copier, a laser printer, or the like generally employs a relatively simple mechanism for recovery from a POP jam, in which a frame of the apparatus is opened widely to assume an alligator-mouth-like opening and a recording sheet stuck to an image carrying body can be removed through the opening.

On the other hand, in color copiers, since it is necessary to repeatedly transfer a toner image of multiple colors to a recording sheet from an image carrying body, a transfer drum rotating in synchronization with the image carrying body is disposed at a position facing the image carrying body with a transfer position of the toner image between, and the recording sheet is fed repeatedly into the transfer position of the toner image in a state in which it is electrostatically attracted to the transfer drum. Therefore, in a color copier comprising such a transfer drum, the rear end of a recording sheet involved in a POP jam is stuck to the transfer drum, thus a structure for drawing out the transfer drum axially from the position facing the image carrying body is adopted and the recording sheet involved in a POP jam is taken out to the outside of the system together with the transfer drum.

The mechanism for drawing out the transfer drum axially is provided with a mechanism wherein a front panel of a transfer unit containing the transfer drum is provided with a lever, a transfer roller is set apart from a photoreceptor drum by turning the lever, and at the time a lock mechanism of the transfer unit and the system main body is released, enabling the transfer unit to be drawn out. In such a mechanism, when the lock mechanism is released and the transfer unit is drawn out slightly, the lever is locked and the transfer drum rotates only slightly. Therefore, when the transfer unit is drawn out from the apparatus main body or inserted thereinto, the state in which the transfer drum is set apart from the photoreceptor drum is held, preventing the transfer unit from interfering with the photoreceptor drum and being broken when the transfer unit is moving.

The former mechanism for opening the system frame to assume an alligator-mouth-like opening and removing a POP jam through the opening is comparatively easily applied to small-scaled copiers, laser printers, etc., but is difficult to apply to large-scaled, heavy copiers, etc. having a large number of devices around an image carrying body.

With the latter mechanism for drawing out the transfer drum axially for removing a POP jam, if the rear end of a recording sheet involved in a POP jam is not stuck to the transfer drum, only the transfer drum is drawn out with the recording sheet remaining in the system. Therefore, if a configuration is adopted wherein a recording sheet is attracted to a transfer drum at the same time as a toner image is transferred to the recording sheet, the rear end of the recording sheet involved in a POP jam is not yet stuck to the transfer drum and therefore the POP jam cannot be removed simply by drawing out the transfer drum axially. If the recording sheet involved in a POP jam is thus left in the system, the user of the copier cannot remove the recording sheet unless he or she dips his or her hand into the depth of the system; the removal work is extremely dangerous and the recording sheet may be unable to be removed.

Further, in the above-mentioned mechanism for drawing out the transfer unit, when the lock mechanism of the transfer unit and the apparatus main body is released and the transfer unit is slightly drawn out, turning the lever is locked. The lock mechanism may not work due to a slight position difference in the turn direction of the lever at the time. Thus, the transfer unit may be drawn out with the lever unlocked; there is a possibility that the transfer drum may interfere with the photoreceptor drum, etc. and be broken.

Further, if driving the main motor is stopped when a jam is sensed in conventional image forming apparatuses, a time lag occurs between the point in time and complete stopping of rotation bodies such as a photoreceptor drum. This time lag is caused by the inertia of the rotation bodies; a large overrun of a sheet is caused by the inertia particularly in high-speed image forming apparatuses.

Thus, when a POP jam occurs, the tip of an overrun sheet rushes into a cleaner etc. disposed in the vicinity of the photoreceptor drum; there is a fear of incurring a trouble that the user cannot easily effect recovery from the jam or a failure occurs in the parts.

SUMMARY OF THE INVENTION

It is therefore a first object of the invention to provide an image forming apparatus which enables, by means of a simple mechanism, an operator to easily remove a recording sheet that is involved in a POP jam from the apparatus.

It is a second object of the invention to provide an image forming apparatus that can reliably prevent a user from conducting an erroneous operation when he draws out or inserts a transfer unit, to thereby prevent a breakage accident.

It is a third object of the invention to provide an image forming apparatus that can restrict the position of a jammed sheet so that an operator can easily take out a sheet that has caused a POP jam.

According to a first aspect of the invention, there is provided an image forming apparatus comprising an image carrying body; a transfer transport body for transporting an image-transferred recording sheet; an engagement member disposed upstream, in a recording sheet transport direction, of a transfer position so as to be drawn out together with the transfer transport body along an axis of the image carrying body, for pressing, in a draw-out direction, a rear end portion of a jammed recording sheet being wrapped around the image carrying body when the transfer transport body is drawn out; and a sheet retainer member disposed downstream of the transfer position and adjacent to the image carrying body so as to be opposed to the transfer transport body, the sheet retainer member being drawn out together with the engagement member.

With this configuration, when a POP jam occurs, if the transfer transport body is drawn out in the axial direction of the image carrying body, the engagement member is also drawn out. Since the engagement member is disposed upstream in the transport direction of the recording sheet from the toner image transfer position, it presses the rear end of the recording sheet stuck to the image carrying body in the drawing-out direction. On the other hand, since the tip of the recording sheet remains stuck to the image carrying body, a rotation force with the engagement member as a supporting point occurs on the recording sheet pressed at the rear end in the drawing-out direction, and the tip of the recording sheet bends from the margin on the front side of the drawing-out direction and is peeled off gradually from the image carrying body.

At this time, the plate-like sheet retainer member drawn out together with the engagement member is disposed at a position near the image carrying body and downstream in the transport direction of the recording sheet from the transfer position and moreover has the depth side in the drawing-out direction hanging over toward the image carrying body rather than the front side. Thus, the recording sheet bending from the margin on the front side slides into the lower side of the sheet retainer member from the bend. Therefore, when the engagement member is drawn out to the front side, the tip of the recording sheet is peeled off from the image carrying body, enters the lower side of the sheet retainer member in the bend state, and is sandwiched between the sheet retainer member and the transfer transport body opposed thereto.

Thus, when the engagement member, the sheet retainer member, and the transfer transport body are drawn out to the front side of the axial direction of the image carrying body, the recording sheet causing a POP jam to occur is taken out to the outside of the image forming apparatus with the rear end caught in the engagement member and the tip sandwiched between the sheet retainer member and the transfer transport body.

According to the second aspect of the invention, there is provided an image forming apparatus comprising a unit housed in an apparatus main body so as to be drawn out therefrom, the unit comprising an engagement member protruding toward the apparatus main body and having an engagement piece; means for turning the engagement member; and a stopper and a movable stopper located on a turn path of the engagement piece of the engagement member, for restricting a turn range of the engagement member; and the apparatus main body comprising a frame having a through-hole that is so shaped as to allow insertion of the engagement member when the engagement piece exists between the stopper and the movable stopper, the frame driving the movable stopper so that the movable stopper escapes from the turn path of the engagement piece when the engagement member is inserted into the through-hole, and causing the movable stopper to be located on the turn path of the engagement piece, to thereby restrict the turn range of the engagement member when the engagement member is pulled out from the through-hole, wherein the movable stopper is located at a position that prohibits the movable stopper from overlapping with the engagement piece even if the engagement member is turned at the maximum within a space between the engagement member and the through-hole when the engagement member is inserted into the through-hole.

With this configuration, when the unit is inserted into the apparatus main body, the engagement member is passed through the through-hole, whereby the frame and the movable stopper operate in conjunction and the movable stopper is driven, allowing the lock part of the engagement member to pass through the movable stopper. Then, the engagement member is turned and engaged with the frame, whereby the apparatus main body and the unit are connected.

Next, to draw out the unit from the apparatus main body, the engagement member is turned to a position at which it can pass through the through-hole. Then, when the engagement member is pulled out from the through-hole, the frame and the movable stopper operate in conjunction and the movable stopper is driven and placed on the turn path of the lock part, limiting the turn range of the lock part. Even if the engagement member turns to the maximum when it exists in the through-hole, the lock part does not overlap the movable stopper, so that placement of the movable stopper on the turn path is not hindered by the lock part. Thus, the moving part is reliably placed on the turn path of the lock part and limits turn of the lock part. Therefore, for example, if the transfer drum is interlocked with the means for turning the engagement member, when the unit is inserted into or drawn out from the apparatus main body, interlocking the transfer drum is regulated, thus preventing a breakage accident of the transfer drum etc.

The image forming apparatus of this configuration requires that the operator should set the engagement member to the through-hole and insert or pull out the former into or from the latter. Then, at least either of the through-hole and the engagement member is provided with a guide part for guiding the engagement member into the through-hole when the engagement member is inserted into the through-hole, whereby the engagement member can be introduced into the through-hole regardless of where the engagement piece exists between the stopper and the movable stopper.

According to the third aspect of the invention, there is provided an image forming apparatus comprising a sheet transport channel including a registration roller for supplying a sheet that is fed from a tray to an image recording section at predetermined timing; brake means for forcibly stopping rotation of the registration roller; means for sensing occurrence of an abnormality in the paper transport channel during transport of the sheet; and control means for activating the brake means when the sensing means has detected the abnormality.

With this configuration, when an abnormality occurs during sheet transport, the brake means is activated to forcibly stop rotation of the registration roller. Therefore, for instance, at the occurrence of a POP jam, sheet rushing into the cleaner, etc. due to its overrun can be prevented. Also in the case of feeding a sheet to prevent a guillotine jam, sheet rushing into the image recording section due to idle rotation of the registration roller can be prevented.

DESCRIPTION OF THE PREFERRED EMBODIMENTS

Referring to the accompanying drawings, an image forming apparatus according to a first aspect of the invention will be discussed in detail.

Figure 1:
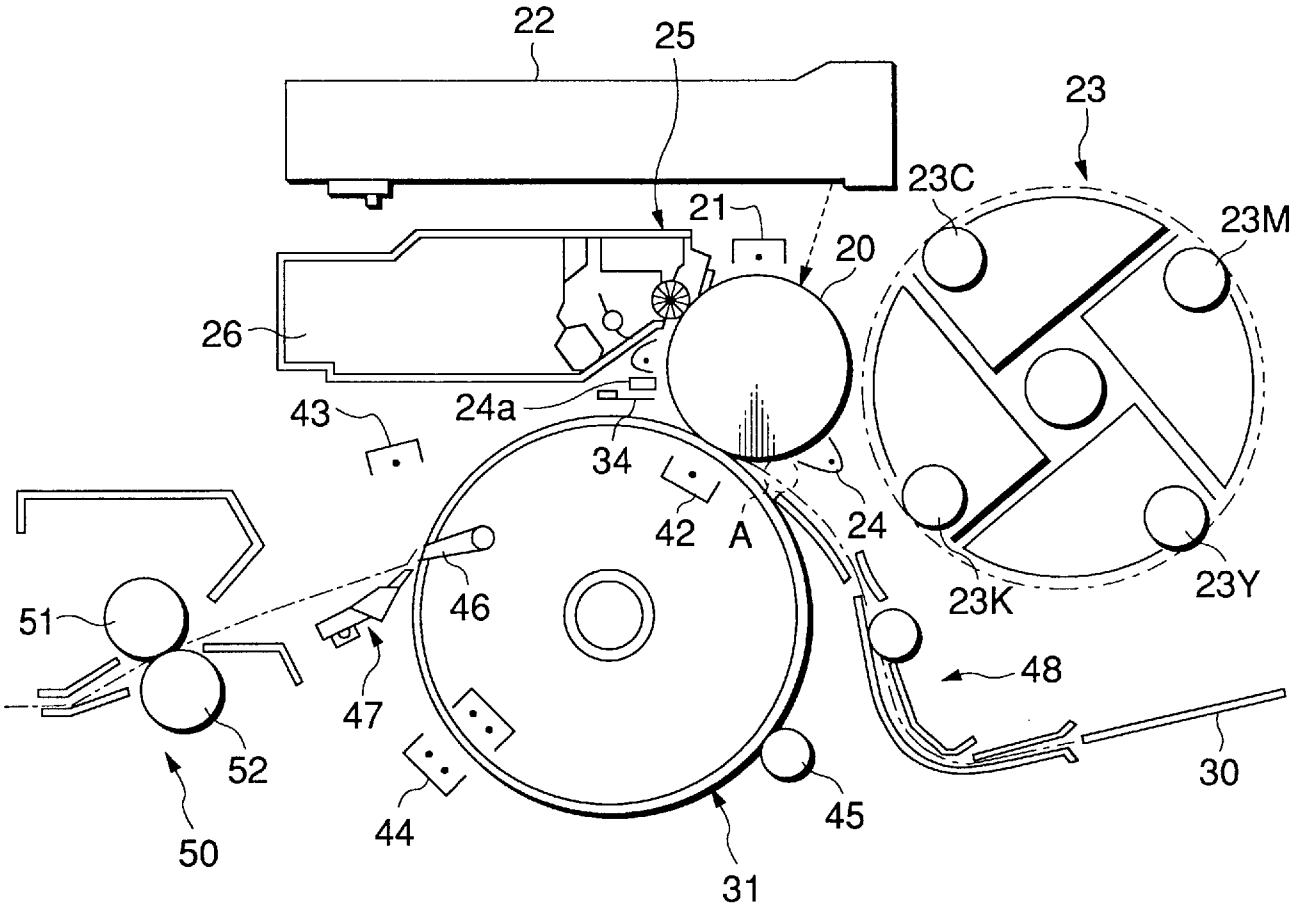
FIG. 1 schematically shows the configuration of a color printer to which a paper jam removal mechanism of the present invention is applied.

FIG. 1 shows an example of a color laser printer to which the invention is applied.

In the figure, numeral 20 is a photoreceptor drum (image carrying body), numeral 21 is a charging corotron for previously charging the surface of the photoreceptor drum 20, numeral 22 is a laser beam scanner for writing an electrostatic latent image onto the photoreceptor drum 20 charged by the charging corotron 21, numeral 23 is a rotary developing unit in which four developing devices 23K, 23C, 23M, and 23Y storing black (K), cyan (C), magenta (M), and yellow (Y) toners are disposed rotatably and are selected appropriately, numeral 24 is a transfer pretreatment corotron for executing charge treatment of toner on the photoreceptor drum 20, numeral 24*a* is a jam detection sensor for detecting a recording sheet 30 stuck to the photoreceptor drum 20 when a POP jam occurs, numeral 25 is a cleaner for removing residual toner on the photoreceptor drum 20, and numeral 26 is a waste toner collection tank molded integrally with the cleaner 25.

On the other hand, numeral 31 is a transfer drum having a peripheral surface around which the recording sheet 30 is wrapped and held for sequentially executing multiple transfer of toner images of color components on the photoreceptor drum 20 to the recording sheet 30. This transfer drum 31 comprises a drum sheet of polyvinylidene fluoride, for example, placed on a drum frame for electrostatically attracting the recording sheet 30 by charging the drum sheet.

The transfer drum 31 is provided with a transfer corotron 42 for transferring a toner image on the photoreceptor drum 20 to the recording sheet 30, an electricity removal corotron 43 for removing electricity of the recording sheet 30 that has been subjected to a transfer step of the last color, a cleaning electricity removal corotron 44 for removing charge on the drum sheet 35 that has been subjected to the transfer step of the last colors, a cleaning brush 45 for cleaning paper powder etc. deposited on the drum sheet that has been subjected to the transfer step of the last color, an inner push roller 46 for pushing up the drum sheet from the inside when the recording sheet is stripped off, and a stripping claw 47 for stripping off the recording sheet 30 from the transfer drum 31.

Further, numeral 48 is a sheet supply channel for guiding a recording sheet 30 supplied from a sheet feed cassette (not shown) into the transfer drum 31; the recording sheet 30 is fed directly into a position where the photoreceptor drum 20 and the transfer drum 31 face each other over the sheet supply channel 48. That is, the transfer corotron 42 also assumes a role in attracting the recording sheet 30 to the transfer drum 31; the recording sheet 30 is attracted to the transfer drum 31 at the same time as a toner image on the photoreceptor drum 20 is transferred to the recording sheet 30.

Numeral 50 is a fuser through which the recording sheet 30 that has been subjected to the transfer step passes. The fuser 50 fuses an unfused toner image onto the recording sheet 30. The fuser 50 consists of a heating roller 51 containing a heater and a pressure roller 52 pressed into contact with the heating roller 51.

In the thus-configured color printer of this embodiment, the laser beam scanner 22 exposes the photoreceptor drum 20 to light based on image information given from a host computer (not shown) ot the like, for writing an electrostatic latent image corresponding to black K onto the photoreceptor drum 20. On the other hand, in the rotary developing unit 23, the black developing device 23K is set to the position opposed to the photoreceptor drum 20 and the electrostatic latent image is developed by the black developing device 23K with a little delay from the write timing. The toner image of black K thus formed is transferred to a recording sheet 30 sent from the sheet supply channel 48 at a predetermined timing. As the toner image is transferred, the recording sheet 30 is attracted to the transfer drum 31. After this, the transfer drum 31 rotates with the recording sheet held. Upon completion of the developing step by the black developing device 23K, the developing device is changed by the time the transfer drum 31 completes one rotation cycle, and as the rotary developing unit 23 rotates 90°, the yellow developing device 23Y is set to the position opposed to the photoreceptor drum 20.

After this, the steps are repeated every rotation cycle of the transfer drum 31 for transferring toner images of yellow Y, magenta M, and cyan C from the photoreceptor drum 20 to the recording sheet 30 held on the transfer drum 31 and forming a toner image comprising the toner images of the four colors overlaid on each other on the recording sheet 30. The recording sheet 30 where the transfer of the toner image of cyan C is complete is stripped off from the transfer drum 31 as it is, and is discharged through the fuser 50 to a discharge tray (not shown).

Next, removal of a POP jam in the color printer will be discussed.

When a so-called POP jam occurs wherein the tip of a recording sheet 30 to which a toner image is transferred is stuck to the photoreceptor drum 20, the color printer is adapted to pull out the transfer drum 31 axially from the position facing the photoreceptor drum 20 and take out the recording sheet 30 involved in the POP jam to the outside together with the transfer drum 31.

Figure 2:
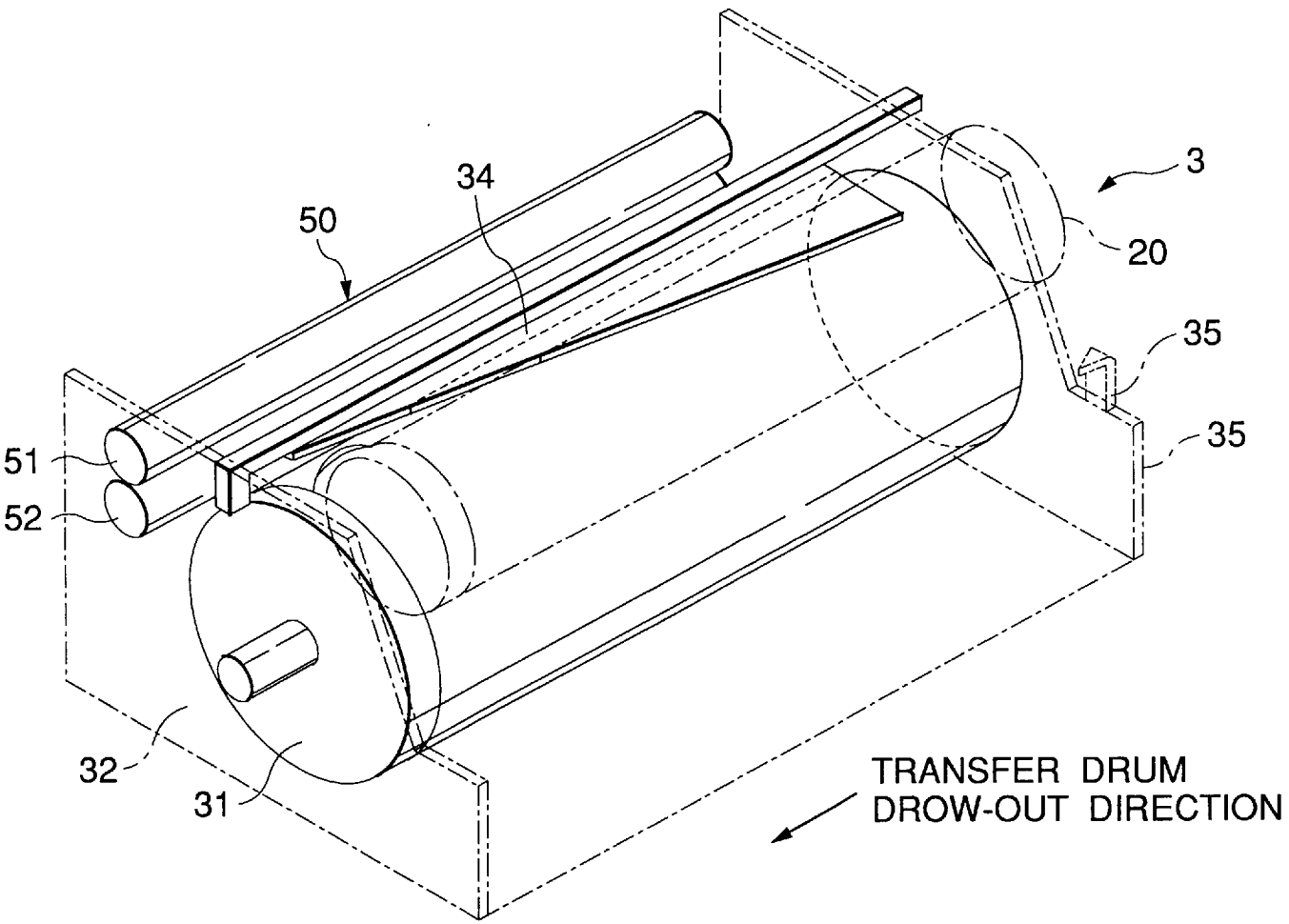
FIG. 2 is a perspective view showing a transfer drum unit according to the embodiment of FIG. 1.

FIG. 2 shows a transfer drum unit 3 with the transfer drum 31 rotatably held. In addition to the transfer drum 31, the fuser 50, the stripping claw 47 (not shown), the sheet supply channel 48 (not shown), and the like are integrally built in the transfer drum unit 3. FIG. 2 shows a state in which the transfer drum unit 3 is housed in a frame of the printer, namely, a state in which the photoreceptor drum 20 and the transfer drum 31 face each other. From this state, the transfer drum unit 3 can be drawn out to the outside of the printer frame along the arrow direction shown in FIG. 2. The transfer drum 31 is supported swingably with respect to the front frame 32 and the rear frame 33 and when the transfer drum unit 3 is drawn out to the outside of the printer frame, the transfer drum 31 can be previously set apart from the photoreceptor drum 20. This structure will be discussed in detail later in an embodiment of a second aspect of the invention.

A sheet retainer member 34 like a plate is attached to the top of the transfer drum unit 3 so as to extend over the front frame 32 and the rear frame 33. This sheet retainer member 34 is disposed substantially in parallel with the peripheral surface of the transfer drum 31. As shown in FIG. 1, it is placed downstream in the transport direction of the recording sheet 30 from the position where the transfer drum 31 and the photoreceptor drum 20 face each other, namely, downstream of the toner image transfer position to the recording sheet 30 near the photoreceptor drum 20. The sheet retainer member 34 is formed like a triangle with the depth side (rear frame 33 side) in the drawing-out direction of the transfer drum 31 hanging over toward the photoreceptor drum 20 rather than the front side (front frame 32 side); the distance between the sheet retainer member 34 and the photoreceptor drum 20 narrows gradually as approaching the rear frame 33 from the front frame 32.

Further, a hook (engagement member) 35 is set upright on the rear frame 33 of the transfer drum unit 3. This hook 35 is disposed upstream in the transport direction of the recording sheet 30 from the position where the transfer drum 31 and the photoreceptor drum 20 face each other, namely, corresponding to the inside of broken line circle A shown in FIG. 1. When the transfer drum unit 3 is drawn out, the hook 35 crosses a recording sheet transport passage indicated by the dot-dash line. Therefore, when a POP jam occurs, if the transfer drum unit 3 is drawn out, the hook 35 engages the rear end of the recording sheet 30 involved in the POP jam from the side.

Figure 3:
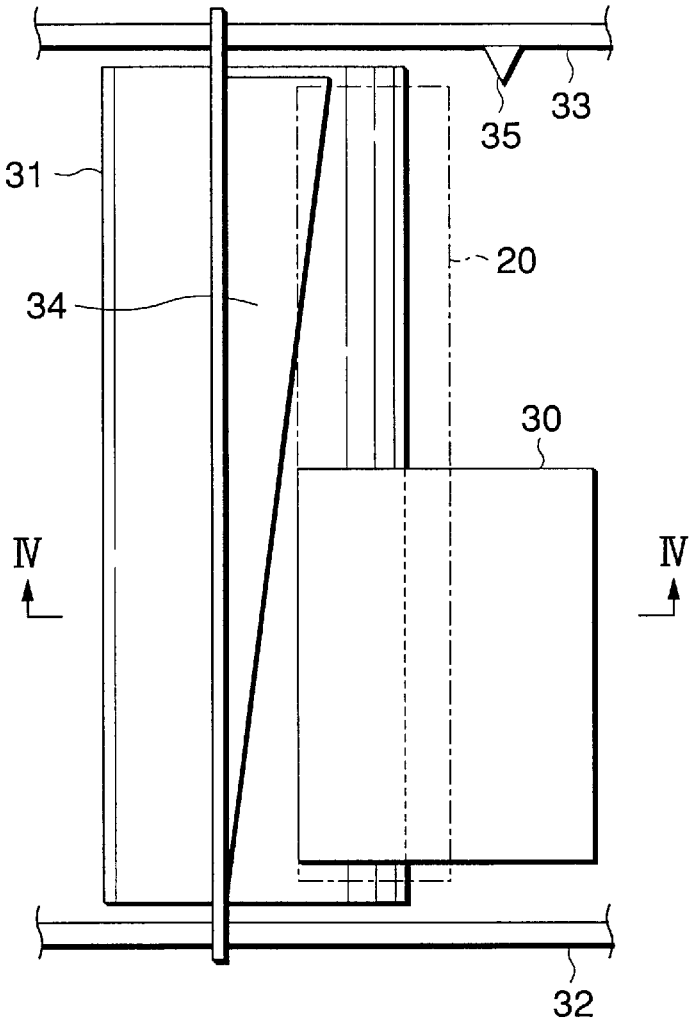
FIG. 3 is a plan view of a photoreceptor drum and a transfer drum in a state that a POP jam has occurred.
Figure 4:
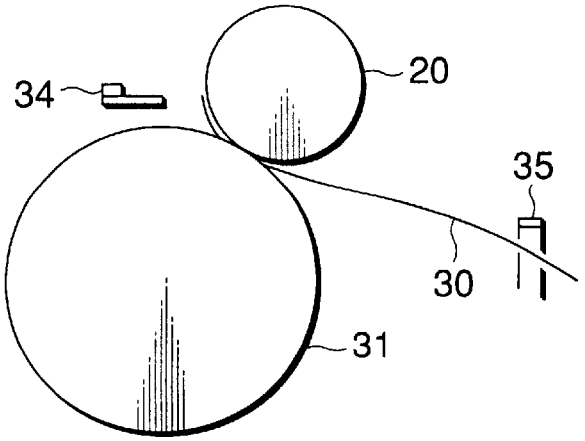
FIG. 4 is a sectional view taken along line IV—IV in FIG. 3.
Figure 6:
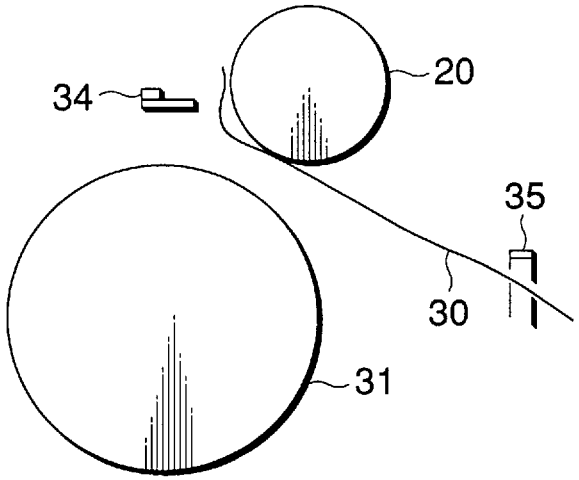
FIG. 6 is a sectional view taken along line VI—VI in FIG. 5.
Figure 7:
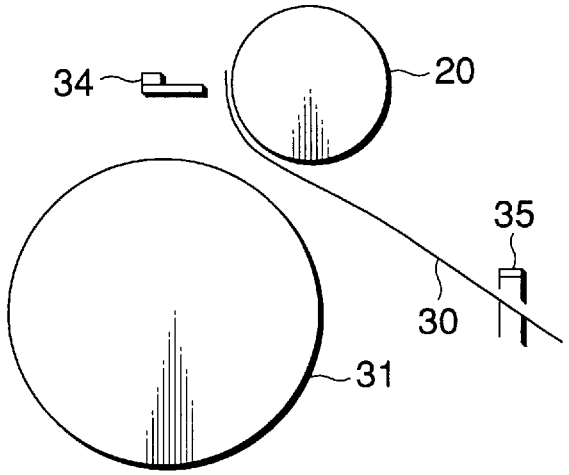
FIG. 7 is a sectional view taken along line VII—VII in FIG. 5.

FIGS. 3 and 4 show a state in which a recording sheet transported from the sheet supply channel 48 causes a POP jam to occur. FIG. 3 is a plan view of observing the photoreceptor drum 20 and the transfer drum 31 from above and FIG. 4 is a sectional view to show the recording sheet 30 stuck to the photoreceptor drum 20. When such a POP jam occurs, the jam detection sensor 24*a* (FIG. 1) disposed downstream from the toner image transfer position detects the recording sheet 30 stuck to the photoreceptor drum 20. Thus, rotation of the photoreceptor drum 20 and the transfer drum 31 are immediately stopped and the recording sheet 30 stops at a position where the tip of the recording sheet 30 passes a little through the position opposed to the sheet retainer member 34 (see FIG. 4). On the other hand, the rear end of the recording sheet 30 is not yet attracted to the transfer drum 31 and when the recording sheet 30 is observed from the front frame 32 side of the transfer drum unit 3, the hook 35 set upright on the rear frame 33 and the rear end of the recording sheet 30 overlap, as shown in FIG. 4. FIG. 4 shows a state in which the transfer drum 31 abuts the photoreceptor drum 20; the hook 35 and the rear end of the recording sheet 30 may overlap in a state in which the transfer drum 31 is set apart from the photoreceptor drum 20, as shown in FIGS. 6 and 7.

Figure 5:
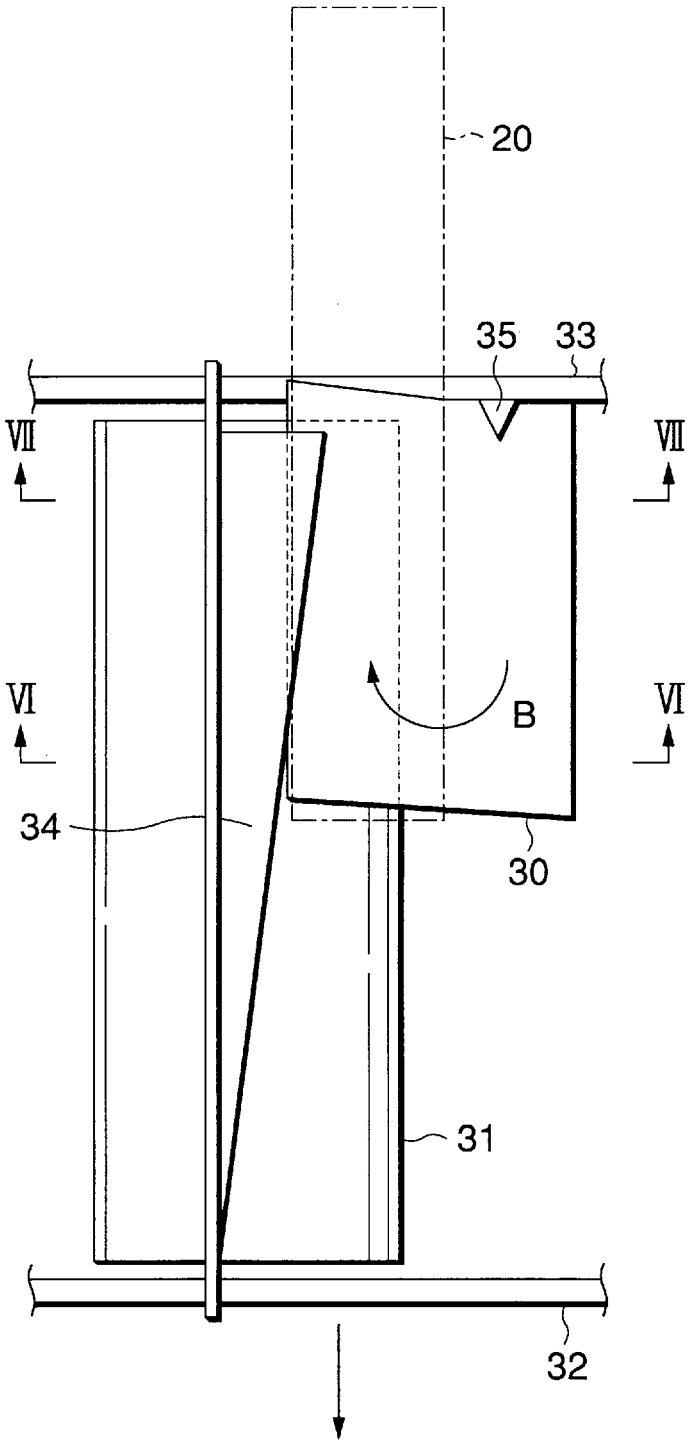
FIG. 5 is a plan view of the photoreceptor drum and the transfer drum in a state that a transfer drum unit is drawn out halfway to effect recovery from a POP jam.

On the other hand, FIG. 5 shows a state in which the transfer drum unit 3 is drawn out to an intermediate point in order to remove the recording sheet 30 causing the POP jam to occur. Since the recording sheet 30 causing the POP jam to occur is not attracted to the transfer drum 31, it is moved from the front frame 32 side of the transfer drum unit 3 to the rear frame 33 side as it is stuck to the photoreceptor drum 20 as the transfer drum unit 3 is drawn out. When the drawing-out amount of the transfer drum unit 3 furthermore increases, the recording sheet 30 attempts to climb over the rear frame 33 and remain in the printer, but at this time, the hook set upright on the rear frame 33 engages the rear end of the recording sheet 30 from the side thereof, as shown in FIG. 5.

Thus, a pressing force acts on the rear end of the recording sheet 30 from the hook 35 and a rotation force in the arrow B direction in FIG. 5 occurs on the recording sheet 30. Resultantly, the tip of the recording sheet 30 stuck to the photoreceptor drum 20 bends from the margin on the front side of the drawing-out direction of the transfer drum 31, and is gradually stripped off from the front of the photoreceptor drum 20 as shown in FIG. 6. On the other hand, as shown in FIG. 7, at this stage the tip of the recording sheet 30 is not completely stripped off from the photoreceptor drum 20 and the margin on the depth of the recording sheet 30 still remains stuck to the photoreceptor drum 20.

Figure 8:
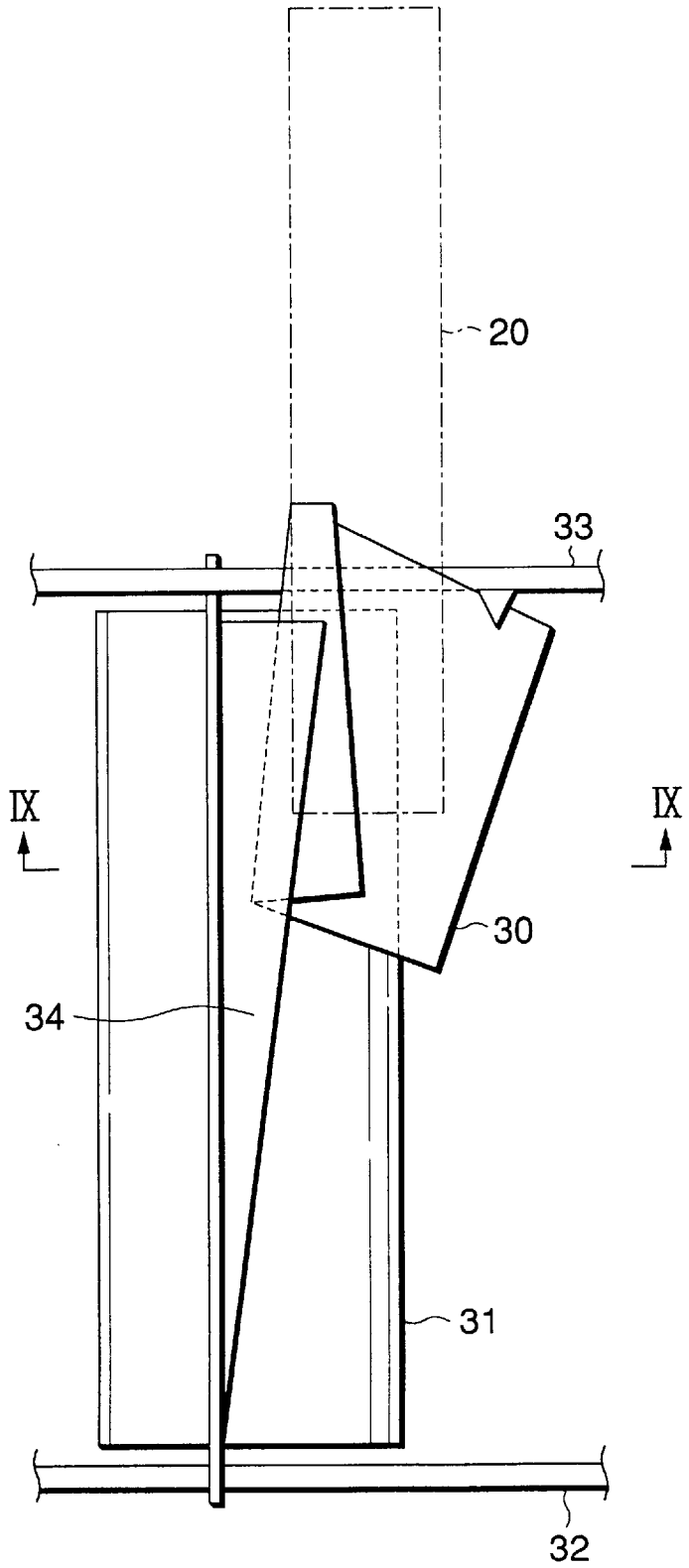
FIG. 8 is a plan view of the photoreceptor drum and the transfer drum in a state immediately before the transfer drum unit is drawn out completely.
Figure 9:
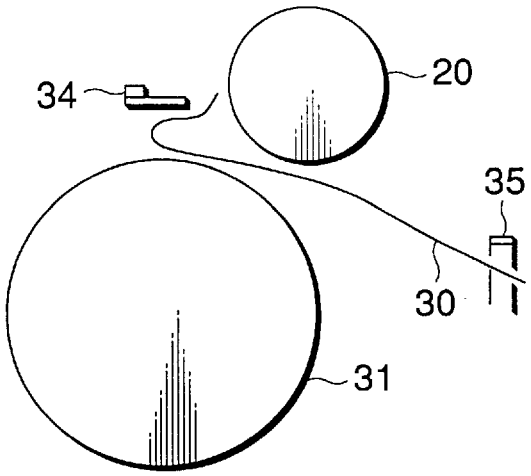
FIG. 9 is a sectional view taken along line IX—IX in FIG. 8.

When the transfer drum unit 3 is furthermore drawn out from the state shown in FIG. 5, the tip of the recording sheet 30 is completely stripped off from the photoreceptor drum 20, as shown in FIG. 8. Since the overhanging amount of the sheet retainer member 34 to the photoreceptor drum 20 increases gradually from the front frame 32 side to the rear frame 33 side, the recording sheet 31 bending from the margin of the front side slips under the sheet retainer member 34 from the bend part as the bend amount increases. Therefore, just before the transfer drum unit 3 is completely drawn out from the printer frame, the tip of the recording sheet 30 is completely stripped off from the photoreceptor drum 20, and is sandwiched between the sheet retainer member 34 and the transfer drum 31, as shown in FIG. 9.

Thus, the recording sheet 30 stripped off from the photoreceptor drum 20 engages the hook 35 at the rear end and on the other hand, is sandwiched at the tip between the transfer drum 31 and the sheet retainer member 34. When the transfer drum unit 3 is drawn out to the outside of the printer frame, the recording sheet 30 is also drawn out to the outside of the printer frame together with the transfer drum unit 3, enabling the operator (user) to remove the recording sheet 30 involved in the POP jam without dipping his or her hand into the printer frame.

We have discussed the case in which the recording sheet 30 sent from the sheet supply channel 48 causes a POP jam to occur; however, if a POP jam occurs on a recording sheet 30 already attracted to the transfer drum 31, for example, a recording sheet 30 where transfer of a toner image of the first color is complete and a toner image of the second color is being transferred, the rear end of the recording sheet 30 is electrostatically attracted to the transfer drum 31, thus enabling the operator (user) to easily take out the recording sheet 30 involved in the POP jam to the outside of the printer frame simply by drawing out the transfer drum unit 3.

On the other hand, even if a recording sheet 30 is already attracted to the transfer drum 31, when it has a weak attraction force to the transfer drum 31, as the transfer drum unit 3 is drawn out, the recording sheet 30 may peel off from the transfer drum 31 and be left in the printer frame in a state in which it is stuck to the photoreceptor drum 20. However, even in such a case, the recording sheet 30 involved in the POP jam can be taken out to the outside of the printer frame in a similar manner to that described above, because the hook 35 set upright on the rear frame 33 always engages such a recording sheet 30 as the transfer drum unit 3 is drawn out.

Figure 10A:
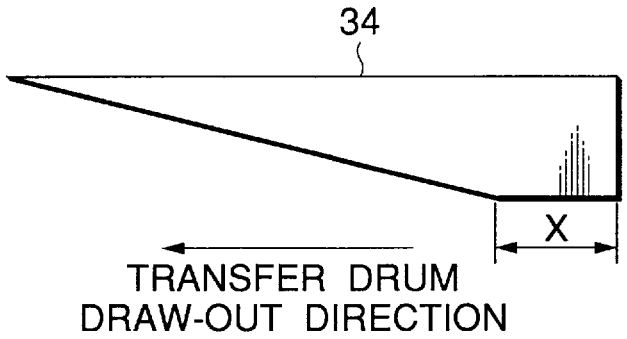
FIGS. 10A and 10B are plan views of other examples of sheet retainer members.
Figure 10B:
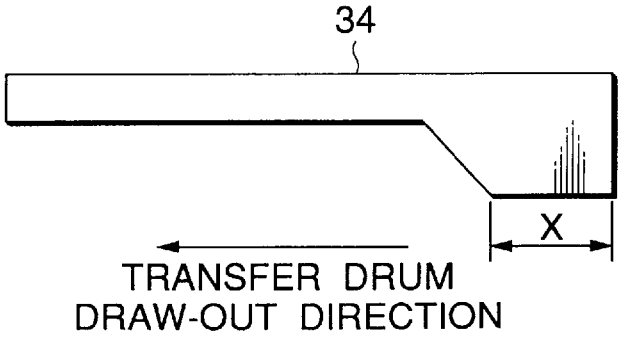

In the invention, the shape of the sheet retainer member 34 is not limited to a triangle as shown in FIG. 2; it may be shaped as shown in FIG. 10A or 10B as long as the overhanging amount of the sheet retainer member 34 to the photoreceptor drum 20 increases gradually from the front frame 32 side to the rear frame 33 side. However, preferably the axial length of the portion most hanging over to the photoreceptor drum 20, x, is a half or less of the width of a recording sheet of the minimum size used with the printer.

Figure 11:
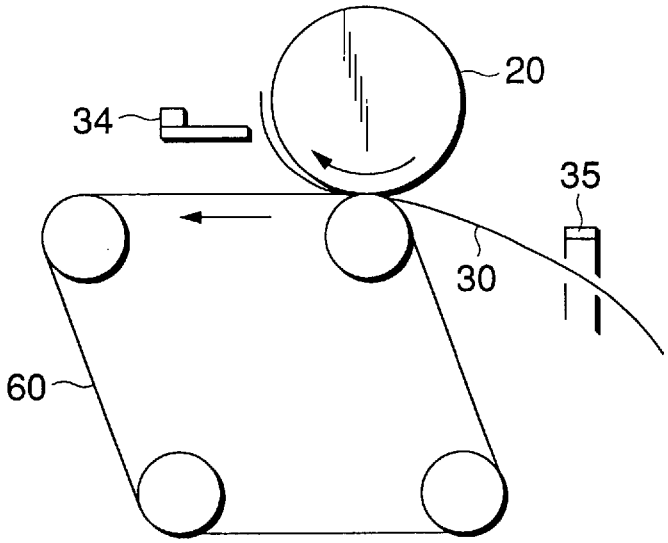
FIG. 11 schematically shows a color printer using an endless transfer belt in place of the transfer drum.

As shown in FIG. 11, the invention can also be embodied likewise if an endless transfer belt 60 is used in place of the transfer drum 31. In such a case, the recording sheet 30 causing a POP jam to occur is taken out to the outside of the printer frame together with the transfer belt 60 by drawing out the sheet retainer member 34 and the hook 35 in the axial direction of the photoreceptor drum 20 together with the transfer belt 60.

Figure 12:
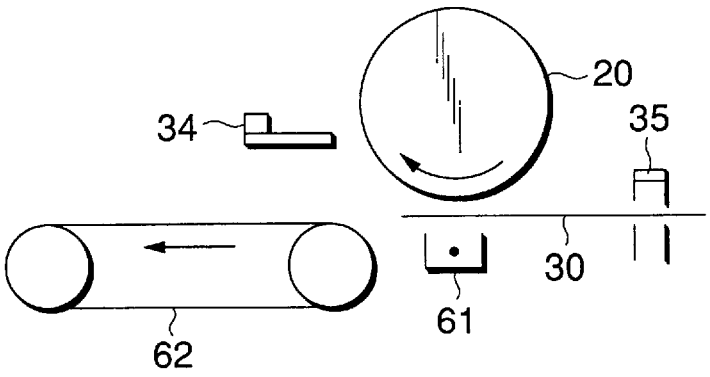
FIG. 12 schematically shows an embodiment in which the invention is applied to a black-and-white printer.

Further, FIG. 12 shows an example of applying the invention to an ordinary black-and-white printer. As shown here, the hook 35 is disposed upstream in the transport direction of a recording sheet 30 from the toner image transfer position where a transfer corotron 61 faces the photoreceptor drum 20; the sheet retainer member 34 is disposed downstream in the transport direction of a recording sheet 30 from the transfer position. A sheet conveyor belt 62 for guiding a recording sheet to which a toner image has been transferred is disposed at a position facing the sheet retainer member 34 with the recording sheet transport passage between. When a POP jam occurs even in the black-and-white printer thus composed, the sheet retainer member 34, the hook 35, and the sheet conveyor belt 62 are drawn out together to the front from the printer frame, whereby the tip of the recording sheet 30 causing the POP jam to occur is stripped off from the photoreceptor drum 20 and is sandwiched between the sheet retainer member 34 and the sheet conveyor belt 62, so that the recording sheet 30 can be taken out to the outside of the printer frame as with the color printer described above.

Next, a mechanism, according to a second aspect of the invention, for inserting/removing a transfer unit in a state that a transfer drum and a photoreceptor drum are set apart from each other will be discussed.

Figure 13:
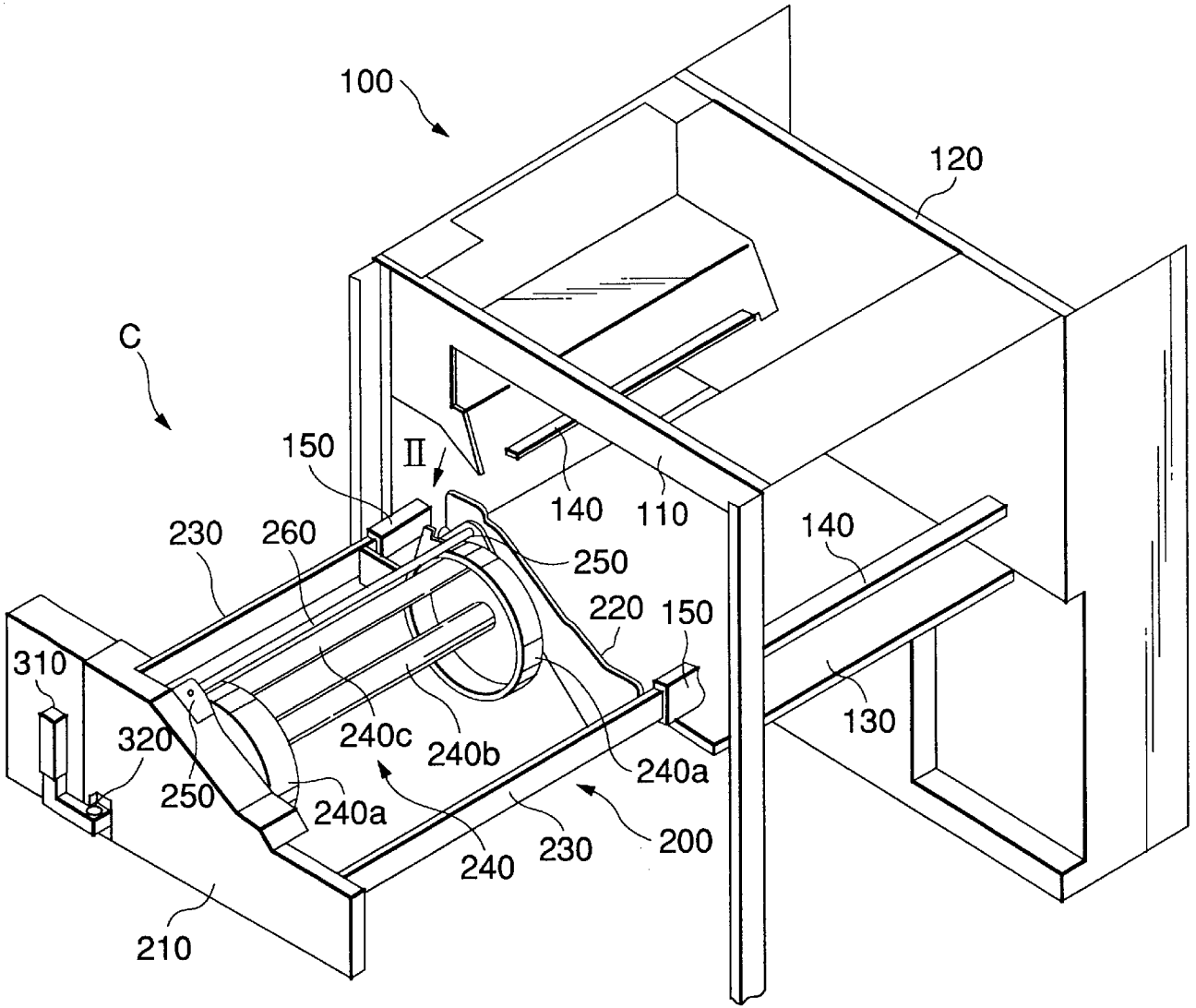
FIG. 13 is a perspective view showing the main part of a color copier according to the invention.
Figure 14:
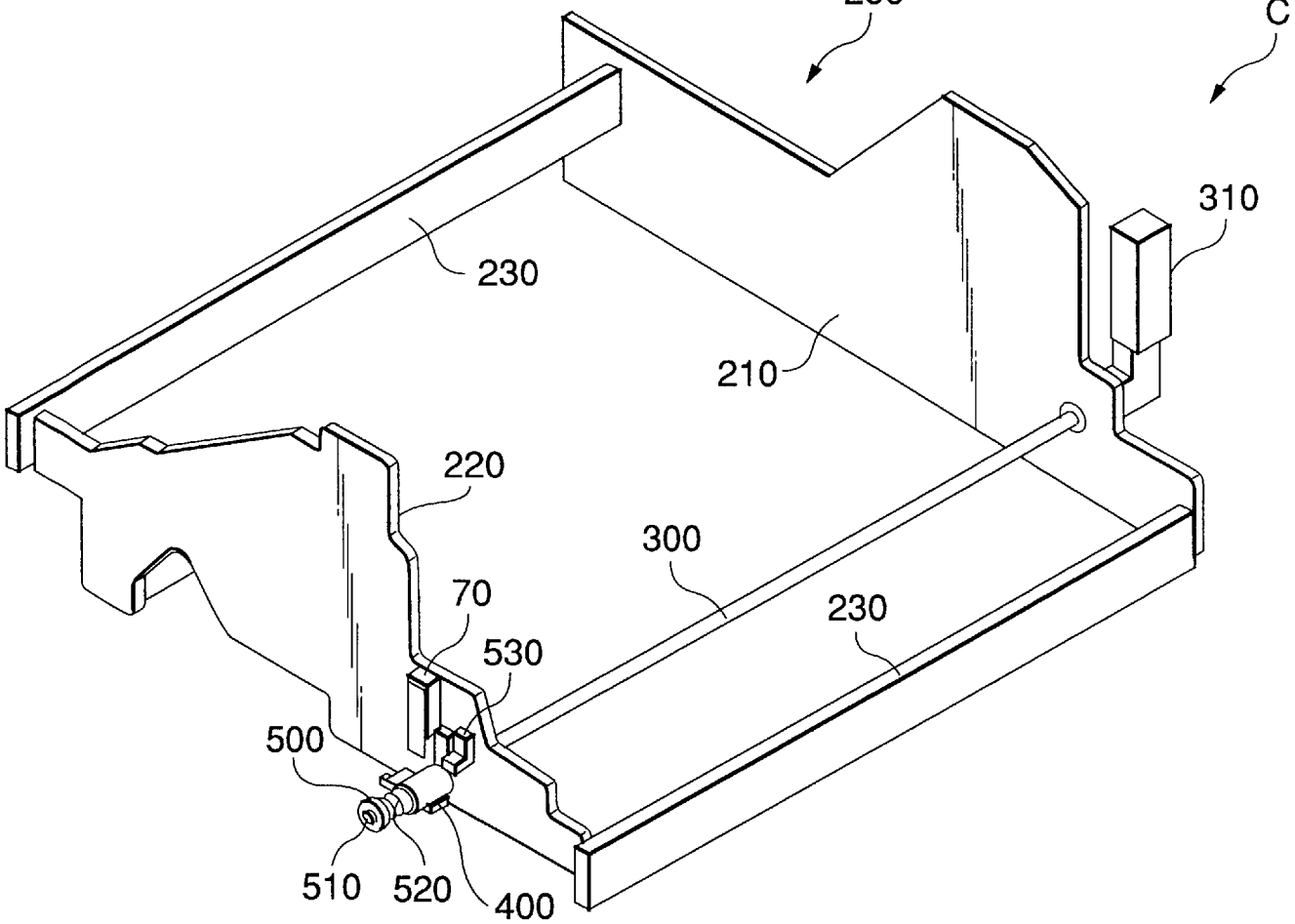
FIG. 14 is a perspective view of a frame 200 of a transfer unit used in the embodiment of FIG. 13.
Figure 15:
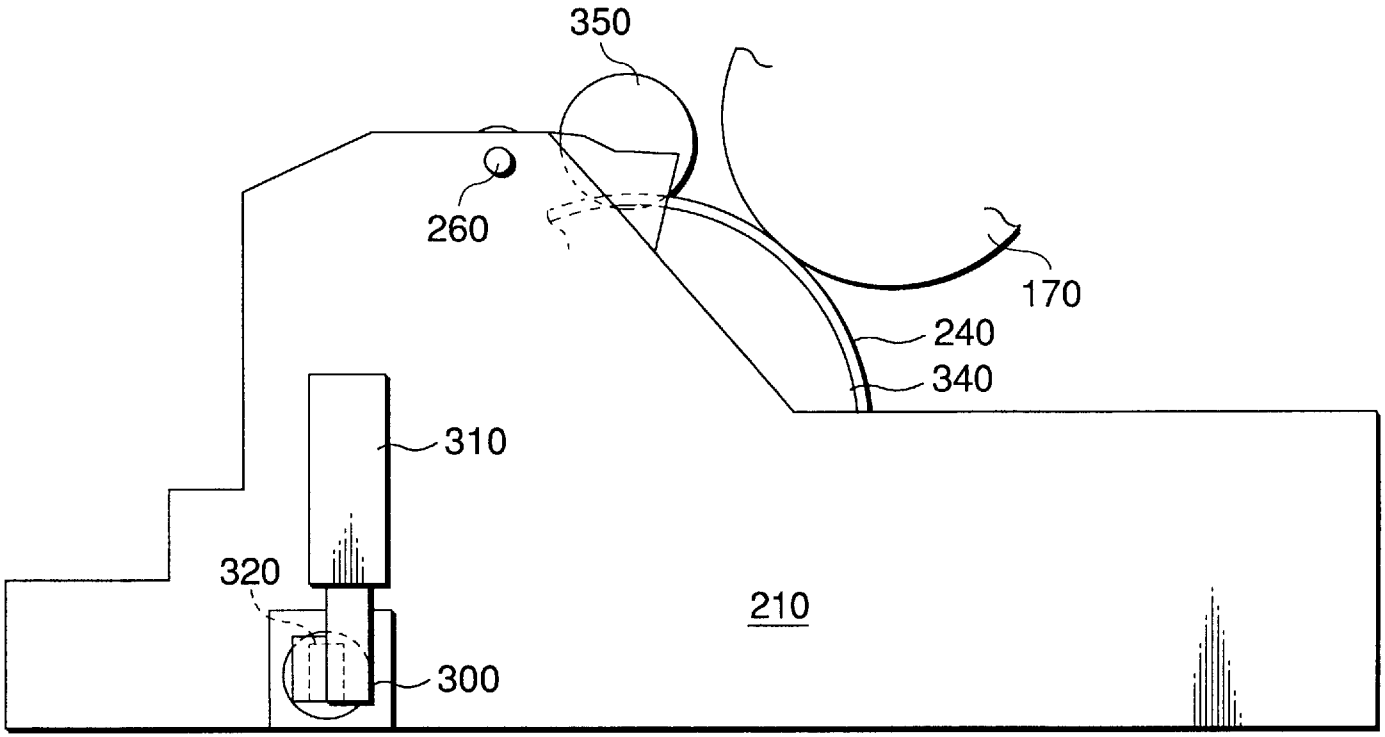
FIG. 15 is a front view of the transfer unit.

FIG. 13 is a perspective view to show a transfer unit (unit) C of a color copier and a part of its main frame (apparatus main body) 100 for storing the transfer unit C. FIG. 14 is a view in arrow III direction of FIG. 13 and shows only a frame 200 of the transfer unit C with internal parts omitted. In FIG. 13, numeral 110 is a front frame of the main frame 100 and numeral 120 is a rear frame (frame). As shown in the figure, the transfer unit C can be drawn out to the front of the main frame 100. Numeral 130 is a middle frame for separating the transfer unit C and its lower portion. Numeral 140 is a support for holding a fixed rail 150 to the main frame 100.

In FIGS. 13 and 14, numeral 210 is a front frame of the transfer unit C and numeral 220 is a rear frame. Slide rails 230 are placed between the front and rear frames 210 and 220; they are attached to the fixed rails 150 slidably in a length direction, whereby the transfer unit C can be slid in the length direction of the rails 140.

Figure 16A:
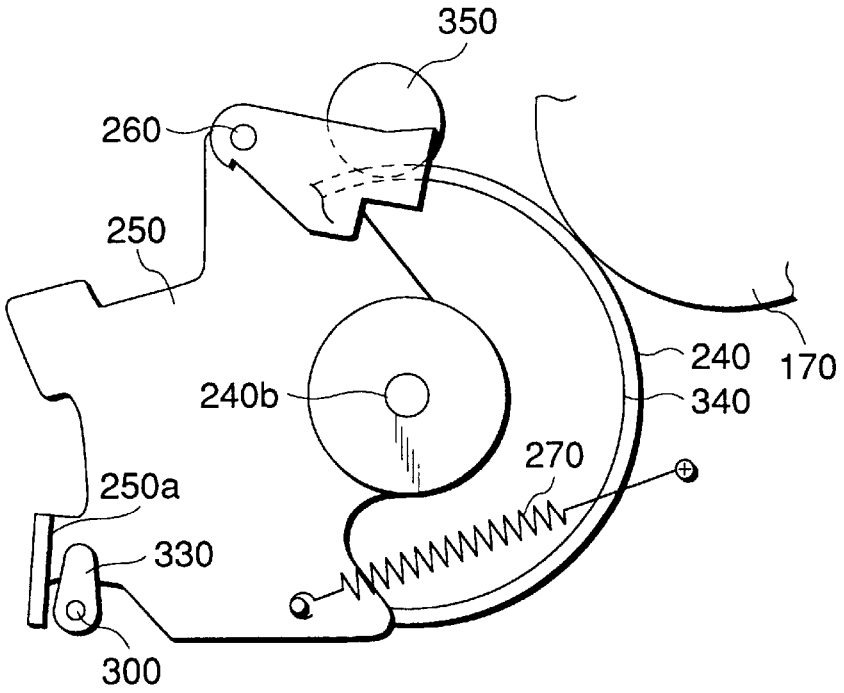
FIGS. 16A and 16B show a positional relationship between a transfer drum and a photoreceptor drum.
Figure 16B:
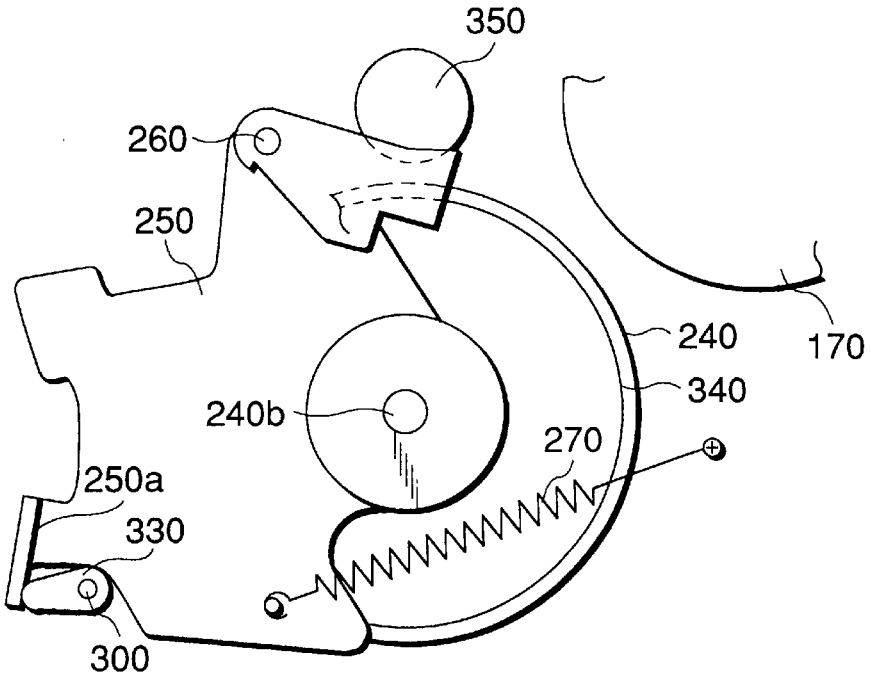
Figure 17A:
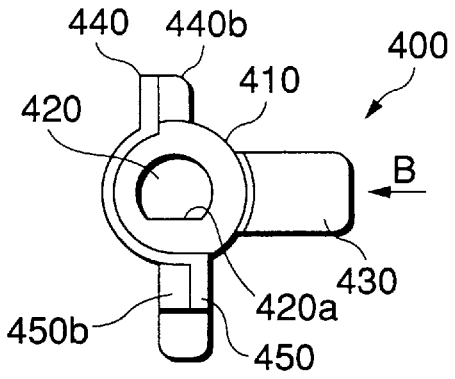
FIG. 17A is a plan view of a lock block.
Figure 17B:
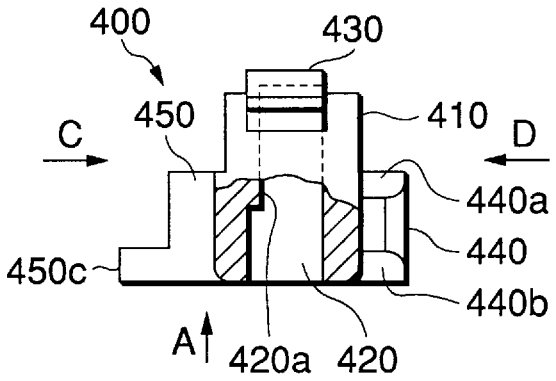
FIG. 17B shows the lock block as viewed from an arrow B direction in FIG. 17A.
Figure 17C:
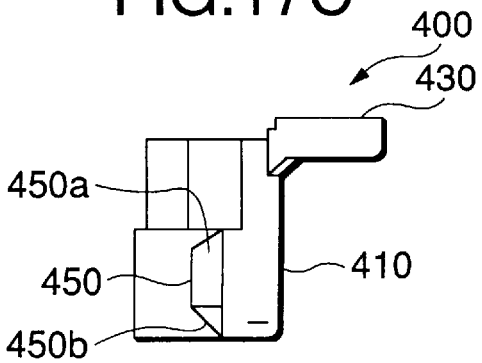
FIG. 17C shows the lock block as viewed from an arrow C direction in FIG. 17B.
Figure 18A:
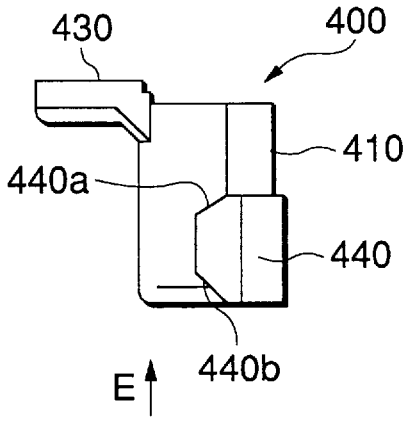
FIG. 18A shows the lock block as viewed from an arrow D direction in FIG. 17B.
Figure 18B:
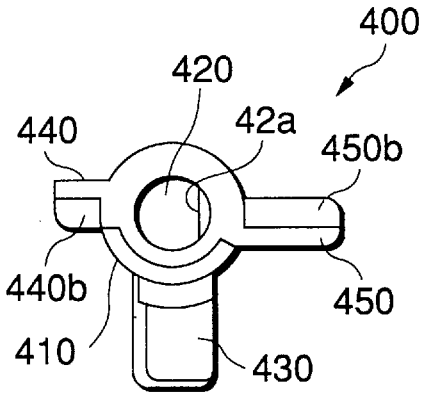
FIG. 18B shows the lock block as viewed from an arrow E direction in FIG. 18A.

Next, in FIG. 13, numeral 240 is a transfer drum which comprises disk-like frames 240*a* coupled by a shaft 240*b* and a tie plate 240*c*; a film or mesh sheet (not shown) is wrapped around the frame 240*a*. FIGS. 16A and 16B show a mechanism for rotating the transfer drum 240. The transfer drum 240 is supported rotatably with respect to swing frames 250 disposed on both sides of the transfer drum 240 and the shaft 240*b* connecting the swing frames 250. The swing frames 250 are supported rotatably by a shaft 260 connecting the front frame 210 and the rear frame 220 of the transfer unit C. A coil spring 270 attached at one end to the frame 200 of the transfer unit C is attached to the lower end of each of the front and rear swing frames 250, thereby energizing the corresponding swing frame counterclockwise in the figure. The swing frame 250 is formed in the lower-left corner with a protrusion 250*a* protruding to the front. The rear swing frame (not shown) is also provided with a coil spring and a protrusion similar to those described above.

Next, as shown in FIG. 14, a shaft 300 is supported rotatably on the front and rear frames 210 and 220 of the frame 200. The shaft 300 and the frame 200 are prohibited from making a relative move axially or can move axially only a predetermined length of about 2 mm, for example. A lever 310 is attached to the front side end of the shaft 300. It is shaped like an L letter and is supported at the lower end pivotably on the end of the shaft 300 by a pin 320. A cam 330 is attached to the shaft 300 (see FIGS. 16A and 16B); it is positioned forward of the protrusion 250*a* of the swing frame 250. A gear 340 is attached to one side of the transfer drum 240 and meshes detachably with a one-way gear 350 attached to the frame 200 of the transfer unit C. When the transfer unit C is housed in the main frame 100, the gear 340 enters a state in which it can be attached to or detached from a drive gear from the main frame 100, and can mesh therewith by handling the lever 310. The one-way gear 350 allows the transfer drum 240 to rotate only in the rotation direction of operation.

When the cam 330 is turned from the state shown in FIG. 16A under the configuration, it presses the protrusion 250*a* and the swing frame 250 turns clockwise in the figure against energy of the coil spring 270, whereby the transfer drum 240 is set apart from the photoreceptor drum 170 and the gear 340 is also set apart from the one-way gear 350. This handling is performed by turning the lever 310; a lock mechanism described below prevents the lever 310 from turning by erroneous handling.

Figure 20A:
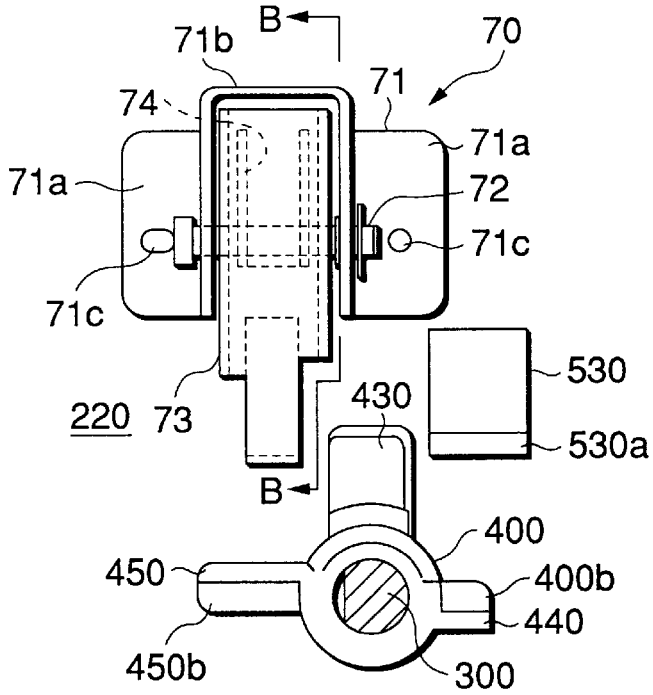
FIG. 20A is a rear view, partially a sectional view taken along line A—A in FIG. 20B, of the lock mechanism.
Figure 20B:
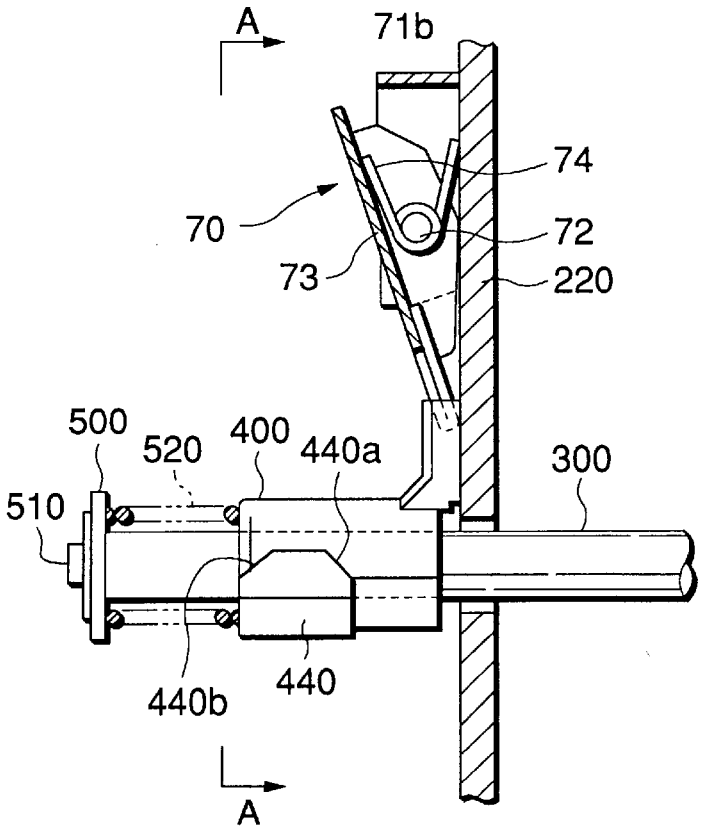
FIG. 20B is a side view, partially a sectional view taken along line B—B in FIG. 19A, of the lock mechanism.

FIG. 20A is a plan view to show a part of the rear frame 220 and FIG. 20B is a sectional view taken along line B—B in FIG. 20A. As shown here, the end of the shaft 300 is projected from the rear frame 220 and passes through a lock block (engagement member) 400 slidably. A washer 500 is attached to the tip face of the shaft 300 by a screw 510 and a coil spring 520 intervenes between the washer 500 and the lock block 400. Energy of the coil spring 520 is set sufficiently stronger than all resistance of a frictional force etc. occurring when the transfer unit C is inserted into the last position of the main frame 100.

FIGS. 17A–17C and 18A–18B show the lock block 400. The lock block 400 has a cylindrical barrel 410 and a hole 420 through which the shaft 300 passes is formed in the barrel 410. A flat part 420*a* is formed on the inner peripheral surface of the hole 420 and the part of the shaft 300 passing through the hole 420 is likewise formed, whereby the lock block 400 can slide axially to the shaft 300, but does not relatively rotate. The barrel 410 is formed at one end with a first lock piece (engagement piece) 430 protruding outwardly in the radius direction. Further, the barrel 410 is formed at an opposite end with second lock pieces 440 and 450 protruding outwardly in the radius direction and set apart almost 180° from each other. Each of the second lock pieces 440 and 450 is formed on both faces with slopes 440*a* and 440*b* or 450*a* and 450*b* inclined in the circumferential direction.

One of the lock pieces 450 is formed with a protrusion 450*c* furthermore protruding toward the outer peripheral side. When the transfer drum 240 is turned to the photoreceptor drum 170 side, the protrusion 450*c* protrudes downwardly from the transfer unit C. When an attempt is made to insert the transfer unit C into the main frame 100 in the state, the protrusion 450*c* abuts the margin of the middle frame 130, preventing the transfer unit C from being furthermore inserted.

A first stopper (stopper) 530 is placed in the vicinity of the lock block 400 having the above-described structure. It is formed with a projection 530*a* projecting to the rear side for regulating turning of the first lock piece 430. A second stopper (movable stopper) 70 is set slightly apart from the first stopper 530. The structure of the second stopper 70 will be discussed with reference to FIGS. 20A and 20B. In FIG. 20A, numeral 71 is a bracket which consists of a pair of mounting brackets 71*a* and a square-bracket-shaped frame 71*b* for connecting the mounting brackets 71*a*, and is attached to the rear frame 220 by screws (not shown) inserted into mounting holes 71*c* made in the mounting brackets 71*a*. A pin 72 is passed through the frame 71*b* and a lock piece 73 is supported rotatably to the pin 72. A spring 74 is attached to the pin 72 for energizing the lock piece 73 counterclockwise in FIG. 20B.

FIG. 20A shows a state in which the first lock piece 430 of the lock block 400 is positioned between the first stopper 530 and the lock piece 73 of the second stopper 70. In this state, the tip of the lock piece 73 is pressed against the rear frame 220 by the spring 74, so that the lock block 400 can turn only between the first stopper 530 and the lock piece 73. When the rear end of the lock piece 73 is pressed by the rear frame 120 of the main frame 100 (see FIGS. 19A and 19B), the lock piece 73 turns and its tip is set apart from the rear frame 220, whereby the lock block 400 can turn across the lock piece 73. In this case, the first lock piece 430 abuts a rib 220*a* formed in the margin of the rear frame 220, thus the turn range of the lock block 400 becomes about 90°.

Figure 19A:
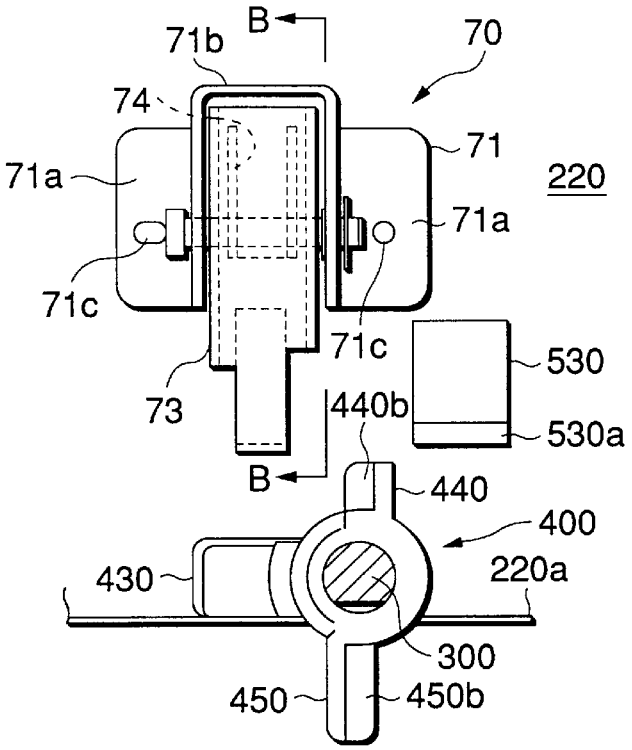
FIG. 19A is a rear view, partially a sectional view taken along line A—A in FIG. 19B, of a lock mechanism for fixing the transfer unit to the main frame.
Figure 19B:
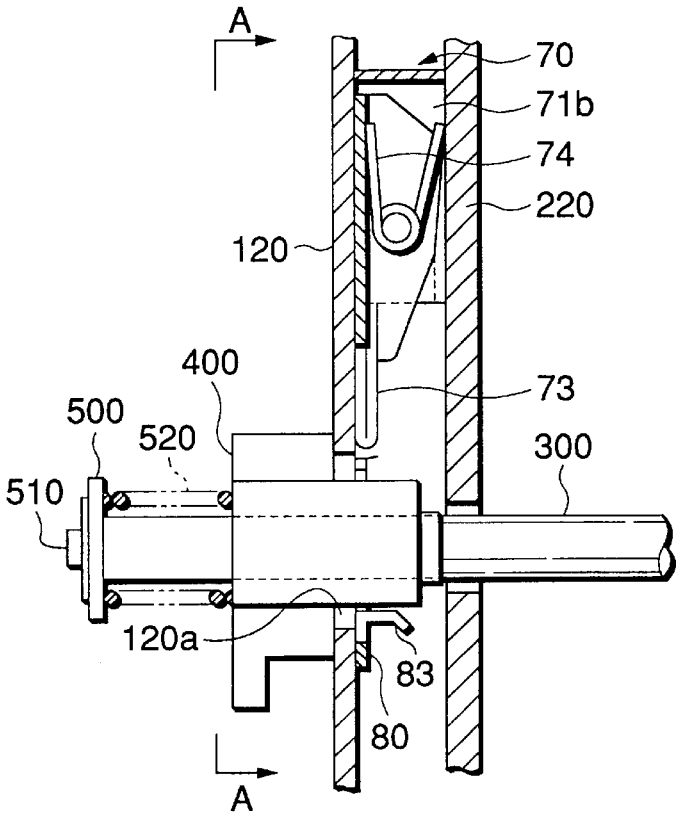
FIG. 19B is a side view, partially a sectional view taken along line B—B in FIG. 19A, of the lock mechanism.
Figure 21A:
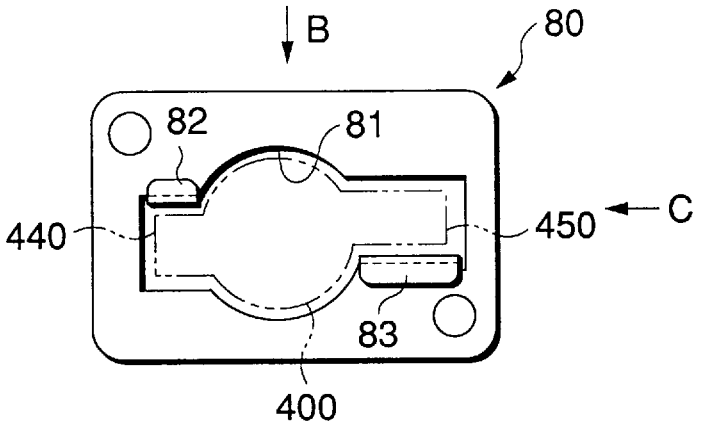
FIG. 21A is a plan view of a guide.
Figure 21B:
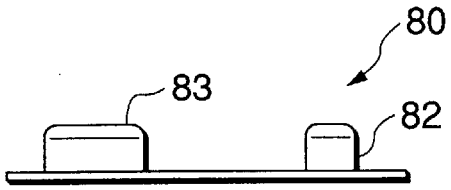
FIG. 21B is a side view of the guide taken from an arrow B direction in FIG. 21A.
Figure 21C:
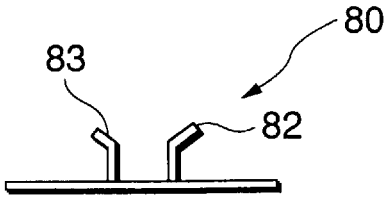
FIG. 21C is a side view of the guide taken from an arrow C direction in FIG. 21A.

A hole 120*a* through which the lock block 400 passes with a margin is made in the rear frame 120 of the main frame 100, as shown in FIGS. 19A and 19B. A guide 80 aligned with the hole 120*a* is attached to the front face of the rear frame 120. FIGS. 21A–21C are drawings to show the guide 80. As shown here, a through-hole 81 having a shape similar to and slightly larger than the plan view contour of the lock block 400 is made at the center of the guide 80. The gap between the through-hole 81 and the lock block 400 when the latter passes through the former is set so that the first lock piece 430 does not overlap the lock piece 73 even if the lock block 400 turns to the limit position within the through-hole 81. Alternatively, the lock piece 73 can also be placed at a position not overlapping the first lock piece 430 when the lock block 400 turns to the maximum for the gap between the through-hole 81 and the lock block 400 when the latter passes through the former.

Guide pieces 82 and 83 for guiding the second lock pieces 440 and 450 of the lock block 400 are protruded on both ends of the through-hole 81. The tips of the guide pieces 82 and 83 are bent so as to spread mutually and can come in sliding contact with the slopes 440*b* and 450*b* formed on the second lock pieces 440 and 450. When the lock block 400 is inserted into the through-hole 81, the slopes 440*b* and 450*b* come in sliding contact with the guide pieces 82 and 83 to introduce the lock block 400 into the through-hole 81 regardless of where the first lock piece 430 exists between the first stopper 530 and the second stopper 70.

Next, the operation of the image forming apparatus having the configuration will be discussed.

FIGS. 19A and 19B show a state in which the transfer unit C is housed in the main frame 100. In this state, the lock block 400 engages the rear frame 120 and the shaft 300 is pulled to the left in the figure by energy of the coil spring 520. Here, the energy of the coil spring 520 is set sufficiently strong, so that the rear frame 220 of the transfer unit C is positioned to the move limit position to the rear side restricted by the presence of the second stopper 70, for example.

To draw out the transfer unit C, first the operator turns the lever 310 shown in FIG. 13 toward him or her, then turns it counterclockwise, whereby the cam 330 turns counterclockwise in FIG. 16A for pressing the protrusion 250*a* of the swing frame 250, whereby the swing frame 250 pivots on the pin 260 clockwise. Resultantly, the transfer drum 240 is set apart from the photoreceptor drum 170 and the gear 340 is also set apart from the one-way gear 350.

The operator turns the lever 310 counterclockwise (when viewed from the direction of the front frame 210 in FIG. 13), whereby the lock block 400 turns clockwise (when viewed from the direction of the rear frame 220 in FIG. 19A) from the state shown in FIG. 19A. The turning operation of the lock block 400 is regulated by the first lock piece 430 abutting the first stopper 530, and at the turning end, the lock block 400 is placed at a position where it can pass through the through-hole 81 of the guide 80. Therefore, if the operator pulls the lever 310 toward him or her in this state, the lock block 400 passes through the through-hole 81 and the transfer unit C is drawn out together with the shaft 300. At this time, if the second lock pieces 440 and 450 disposed in the lock block 400 are not positioned in the through-hole 81, the transfer unit C is not drawn out from the rear frame 120 of the main frame 100.

When the operator pulls the lever 310 toward him or her, the rear frame 220 of the transfer unit C together with the shaft 300 is set apart from the rear frame 120 of the main frame 100. Resultantly, the lock piece 73 of the second stopper 70 turns counterclockwise by energy of the spring 74 from the state shown in FIG. 19B, and the tip of the lock piece 73 abuts the rear frame 220 (see FIG. 20B), whereby the first lock piece 430 of the lock block 400 is disabled from turning beyond the lock piece 73. This means that if the lever 310 is turned in the direction of restoring it to the former position in this state, the transfer drum 240 turns only a little to the side of the photoreceptor drum 170 and is stopped.

Next, the operation for inserting the transfer unit C into the main frame 100 will be discussed. First, the operator holds the lever 310 or the transfer unit C and pushes it into the rear side for passing the lock block 400 through the through-hole 81 of the guide 80. At the time, if the first lock piece 430 of the lock block 400 exists at a position reaching the first stopper 530, the lock block 400 can pass through the through-hole 81 as it is, as with the case described above. In contrast, although the second lock pieces 440 and 450 cross the through-hole 81 of the guide 80 because the first lock piece 430 exists at such a position abutting the lock piece 73, if the position shift of the lock block 400 is not much large, when the lock block 400 is moved to the rear side, the slopes 440*b* and 450*b* of the second lock pieces 440 and 450 are pressed by the guide pieces 82 and 83 for turning the lock block 400 and passing it through the through-hole 81. Therefore, although the lever 310 is at any position in the range in which it can turn, if the operator holds the lever 310 or the transfer unit C and pushes it into the rear side regardless of where the lever 310 exists in the range in which it can turn, the transfer unit C can be inserted into the main frame 100.

Here, the transfer unit C is pushed into the rear side, whereby the rear end of the lock piece 73 of the second stopper 80 is pressed by the rear frame 120 of the main frame 100. Resultantly, the lock piece 73 turns clockwise from the state shown in FIG. 20B against energy of the spring 74 and the tip of the lock piece 73 is set apart from the rear frame 220 (see FIG. 19B). In this state, if the lever 310 is turned almost 90in a direction of restoring it to the former position, the first lock piece 430 passes the lock piece 73 and turns. The lever 310 is turned to the vicinity of a position at which the first lock piece 430 abuts the rib 220*a* of the rear frame 220, whereby the swing frame 250 is turned by the coil spring 27, the transfer drum 240 abuts the photoreceptor drum 170, and the gear 340 meshes with the one-way gear 350.

Next, the motion of the lock block 400 when the above-mentioned operation is performed will be discussed in more detail. When the transfer unit C is pushed into the rear side and reaches the move end, the second lock parts 440 and 450 of the lock block 400 do not completely exit from the through-hole 120*a* of the rear frame 120. That is, the slopes 440*a* and 450*a* of the second lock pieces 440 and 450 are opposed to the margin of the through-hole 120*a*. Although the transfer unit C is pushed into the rear side, it may not completely reach the move end. In this case, the second lock parts 440 and 450 of the lock block 400 do not completely exit from the through-hole 120*a* of the rear frame 120 either.

If the lever 310 is turned in this state, as the lock block 400 turns, the slopes 440*a* and 450*a* comes in sliding contact with the margin of the through-hole 120*a* and the second lock parts 440 and 450 of the lock block 400 completely exit from the through-hole 120*a*. Resultantly, the coil spring 520 shrinks and its energy is transferred via the shaft 300 to the rear frame 220 of the transfer unit C for pressing the rear frame 220 against the rear frame 120 of the main frame 100. Here, if the transfer unit C is not completely inserted into the main frame 100, energy of the coil spring 520 is sufficiently stronger than all resistance when the transfer unit C is inserted to the final position, thus causing the transfer unit C to be inserted to the final position with respect to the main frame 100.

As shown in FIG. 20A, in the state in which the transfer unit C is drawn out from the main frame 100, the first lock piece 430 of the lock block 400 can turn between the first stopper 530 and the lock piece 73 of the second stopper 70 (this range is defined as the turn range at the drawing out time of the transfer unit C). Conventionally, the hole 120*a* was shaped so as to allow the lock block 400 to pass through the hole 120*a* of the main frame 120 regardless of where the lock section 400 exist in the turn range at the drawing out time of the transfer unit C. That is, even if the first lock piece 430 is positioned at the turn end of the lock block 400 coming in contact with the lock piece 73 of the second stopper 70, a gap between the lock block 400 and the hole 120*a*. Therefore, if the lock piece 73 does not exist at a lock position, the lock block 400 can turn to a position where the first lock piece 430 of the lock block 400 overlaps the lock piece 73 in the hole 120*a*.

Here, let's consider a case where the lock block 400 is turned and passed through the hole 120*a* from the state shown in FIG. 19B in the conventional composition described above. At the same time as the lock block 400 moves to the front, the rear frame 220 is set apart from the rear frame 120 of the main frame 100 and the tip of the lock piece 73 approaches the side of the rear frame 220. At this time, if the first lock piece 430 exists at a position overlapping the lock piece 73, the tip of the lock piece 73 turned and restored to the side of the rear frame 220 gets on the first lock piece 430 and the lock block 400 passes the lock piece 73 and can turn after it exits the hole 120*a*. If the user turns the lever 310 by error in the state, there is a danger that the transfer drum 240 will turn and come in contact with the photoreceptor drum 170 and that both will be broken.

In the above embodiment of the invention, when the lock block 400 passes through the through-hole 81, the gap therebetween is set so that the first lock piece 430 does not overlap the lock piece 73 even if the lock block 400 turns to the limit position in the through-hole 81. Thus, the tip of the lock piece 73 turned and restored does not get on the first lock piece 430 regardless of how the lock block 400 is turned. Therefore, the tip of the lock piece 73 is reliably placed on the turn passage of the first lock piece 430, limiting the turn range of the lock block 400. Therefore, turn of the transfer drum 240 is always limited in any state other than the state shown in FIG. 19B wherein the transfer unit C is completely housed in the main frame 100, and an accident such that the transfer drum 240 comes in contact with the photoreceptor drum 170 and is broken does not occur.

In particular, in the above embodiment, regardless of where the first lock piece 430 exists between the first stopper 530 and the second stopper 70, when the lock block 400 is inserted into the through-hole 81, the slopes 440*b* and 450*b* come in sliding contact with the guide pieces 82 and 83, whereby the lock block 400 is guided into the through-hole 81. Thus, when inserting the transfer unit C into the main frame 100, the user need not align the lock block 400. Further, since the slopes 440*a* and 450*a* are also formed on the fronts of the second lock pieces 440 and 450, if the user places the lever 310 roughly horizontally, when the lock block 400 is drawn out, the slopes 440*a* and 450*a* come in sliding contact with the margin of the through-hole 81 of the guide 80, whereby the lock block 400 is guided into the through-hole 81. Thus, according to the embodiment, when drawing out or inserting the transfer unit C from or into the main frame 100, the user need not perform any intricate operation.

When the transfer unit C is inserted into the main frame 100 and the lock block 400 is turned, energy of the coil spring 520 causes the transfer unit C to be pressed against the rear frame 120 of the main frame 100. Thus, even if vibration or the like occurs, the state in which the transfer unit C and the main frame 100 are in intimate contact with each other is held, and trouble such that the transfer drum 240 comes in sliding contact with the photoreceptor drum 170 does not occur. Further, if the transfer unit C is not completely inserted into the main frame 100, energy of the coil spring 520 causes the transfer unit C to move to the final position with respect to the main frame 100, so that the transfer unit C and the main frame 100 can be positioned automatically.

In addition, if the transfer drum 240 is set apart from the photoreceptor drum 170, the gear 340 of the transfer drum 24 is set apart from the one-way gear 350, thus the transfer drum 240 can be rotated forward or reversely. Therefore, easy maintenance can be performed.

To draw out the transfer unit C from the main frame 100 for maintenance, if the user lifts up the lock piece 73 of the second stopper 70, the transfer drum 240 can be turned to the running state. In the embodiment, if the user attempts to insert the transfer unit C into the main frame 100 by error in the state, the protrusion 450*c* formed on the second lock piece 450 of the lock block 400 abuts the margin of the middle frame 130, blocking the transfer unit C from being inserted before the transfer drum 240 collides with the photoreceptor drum 170.

Thus, in the image forming apparatus of the above configuration, even if the user performs any operation, an accident of causing the transfer drum 240 to come in sliding contact with the photoreceptor drum 170 can be prevented and moreover the user need not perform any intricate operation.

Figure 22:
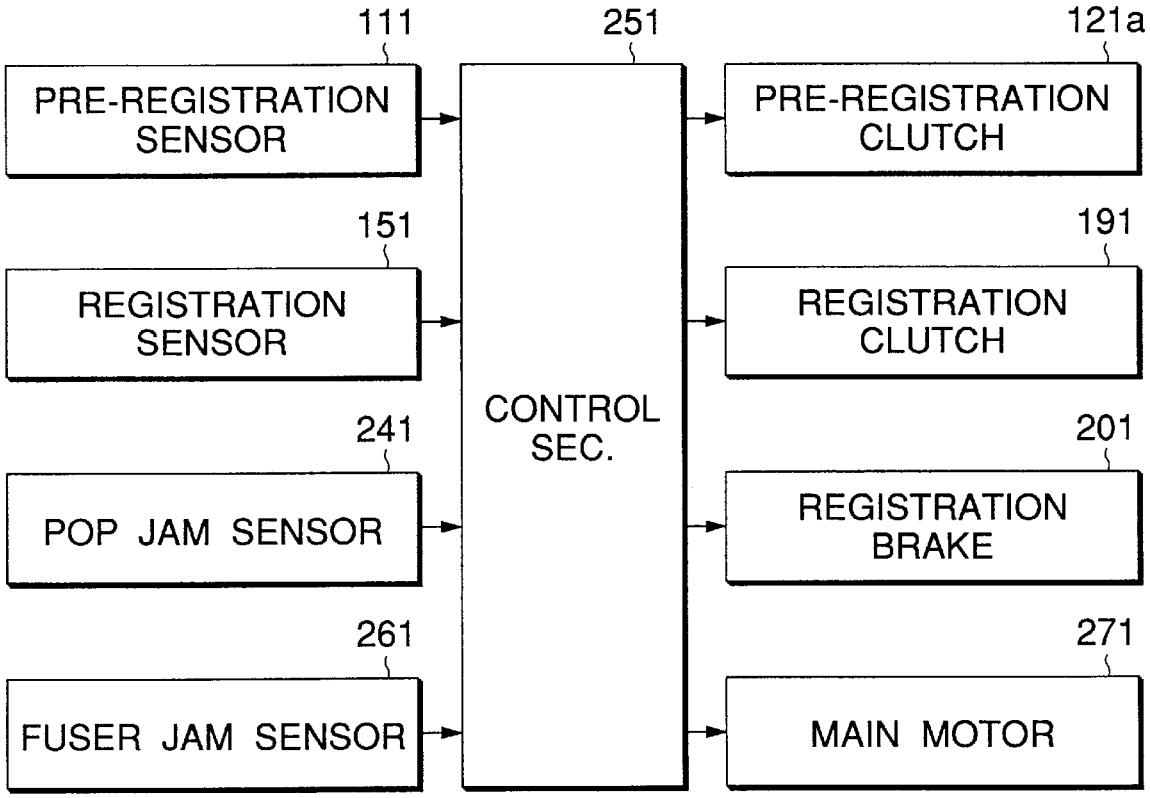
FIG. 22 is a functional block diagram of an image forming apparatus according to an embodiment of the invention.
Figure 23:
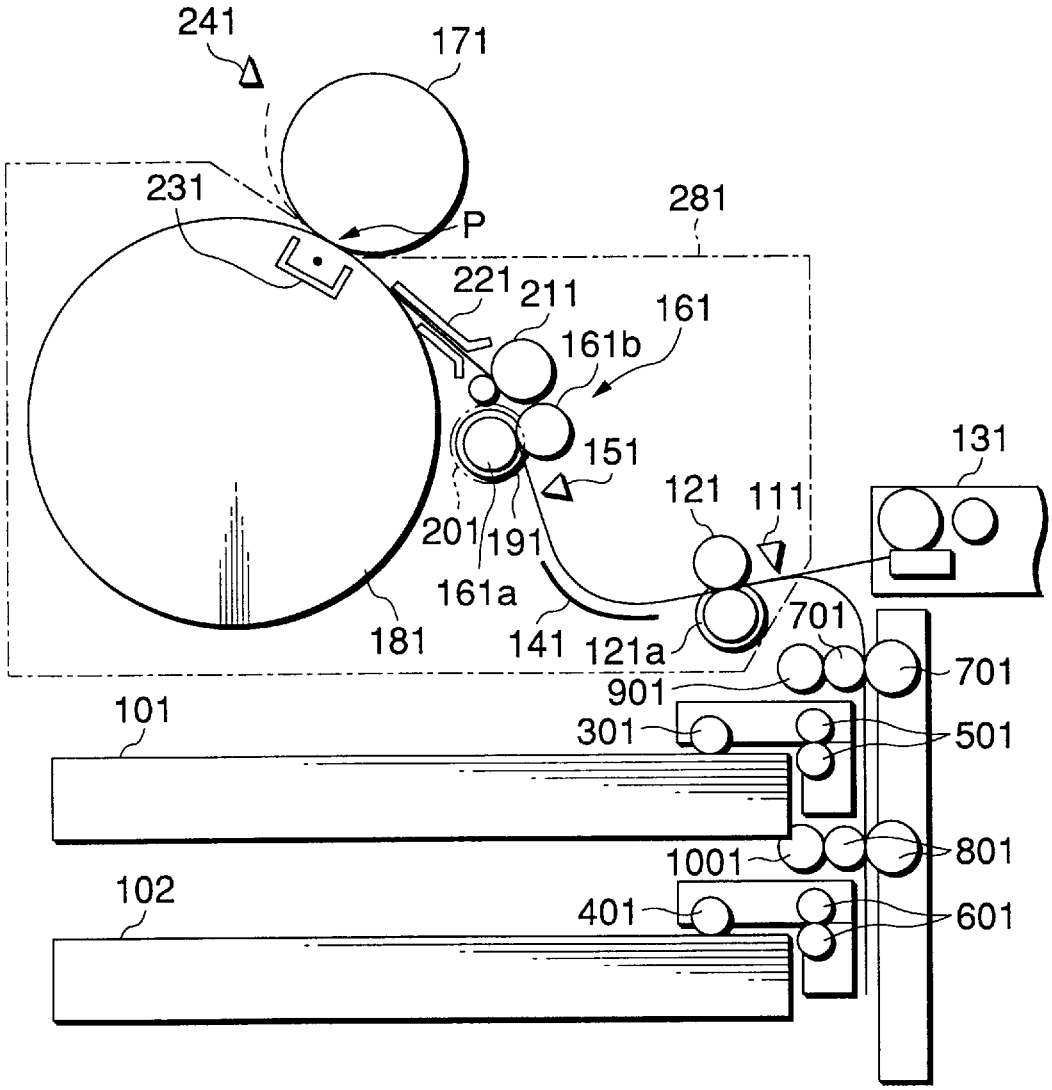
FIG. 23 is a schematic side view showing a mechanical configuration of the image forming apparatus in FIG. 22.

FIG. 22 is a functional block diagram showing an embodiment of an image forming apparatus according to a third aspect of the invention. FIG. 23 is a schematic side view showing a mechanical configuration of the image forming apparatus of FIG. 22.

In the mechanical configuration shown in FIG. 23, trays 101 and 102 are mounted detachably from an apparatus main body, and accommodate sheets not yet subjected to image recording. Draw-out rollers 301 and 401 are disposed at the ends of the respective trays 101 and 102. A sheet taken out by the draw-out roller 301 or 401 is transferred via separation rollers 501 or 601 to feed rollers 701 or 801.

The feed rollers 701 and 801 are separately coupled with the drive source through action of clutches 901 and 1001, and rotated by a drive force thus transmitted from the drive source. A pre-registration sensor 111 for detecting a sheet position at an initial part of transport is disposed downstream from the feed rollers 701 and 801. A sheet taken out of the tray 101 or 102 passes the pre-registration sensor 111 and then arrives at pre-registration rollers 121. Likewise, a sheet fed by roller rotation from a manual feed tray 131 also passes the pre-registration sensor 111 and then arrives at the pre-registration rollers 121.

The pre-registration rollers 121 consist of a pair of rollers, i.e., top and bottom rollers, and a pre-registration clutch 121*a* for connection to and disconnection from the drive source is coupled with the driving side roller.

A paper guide 141 and a registration sensor 151 are disposed in this order along a paper transport passage downstream from the pre-registration rollers 121. The registration sensor 151 detects a position of a sheet that is transported while being guided by the paper guide 141. A sheet that has passed the registration sensor 151 arrives at registration rollers 161. For example, the registration rollers consist of a transport roller 161*a* made of an elastic material and a pinch roller 161*b* made of an inelastic material, and are disposed before an image recording section comprising a photoreceptor drum 171, a transfer drum 181, etc. A registration clutch 191 for connection to and disconnection from the drive source and a registration brake 201 (brake means) for forcibly stopping rotation of the registration rollers 161 are coupled with the drive shaft of the registration roller 161*a*.

The embodiment adopts, as the registration brake 201, a brake mechanism for locking a gear (not shown) attached to the rotation shaft of the registration roller 161*a* by an electromagnetic clutch to thereby forcibly stop rotation of the registration rollers 161. However, the brake means may have various type of configuration. For example, it may be configured such that a rotary plate is mounted on the rotary shaft of the registration roller 161*a* and rotation of the registration roller 161*a* is forcibly stopped by imparting a frictional force to the rotary plate.

Shoot rollers 211 and top and bottom shoot guides 221 are disposed between the registration rollers 161 and the image recording section. The shoot rollers 211 serve to curl a sheet along the peripheral surface of the transfer drum 181, and the shoot guides 221 serve to smoothly guide a sheet supplied from the registration rollers 161 to a transfer point p of the image recording section. The image recording section has a transfer means 231 adjacent to a pressure contact position of the photoreceptor drum 171 and the transfer drum 181. Further, a POP jam sensor 241 for detecting a sheet winding around the photoreceptor drum 171 is disposed in the vicinity thereof.

In FIG. 23, only the photoreceptor drum 171, the transfer drum 181, and the transfer means 231 are displayed as the components of the image recording section. However, in addition to them, a cleaner, a charging section, an exposure section, a developing section, etc. are disposed appropriately around the photoreceptor drum 171. Further, a fusing section comprising a heater etc. is disposed downstream of the image recording section and a sheet on which an image is already recorded is discharged to a discharge bed through the fusing section.

Next, the configuration of a control system of the image forming apparatus of this embodiment will be discussed with reference to FIG. 22.

In FIG. 22, a control section 251 (control means) comprises a CPU, a ROM for storing a control program, and a RAM for storing data for various control operations. Connected to the input of the control section 251, as means for detecting occurrence of an abnormality during sheet transport, are the pre-registration sensor 111 and the registration sensor 151 for detecting positions of a sheet being fed toward the image recording section, a POP jam sensor 241 for detecting the occurrence of a POP jam, and a fuser jam sensor 261 for detecting a paper jam in the fusing section after image recording. Further, software for judging for a failure in the operation of the apparatus is incorporated in the control program of the control section 251. For example, the failure judging software monitors a failure in lines through which control signals flow and a failure in clutches, motors, etc. On the other hand, connected to the output of the control section 251 are the pre-registration clutch 121*a*, the registration clutch 191, the registration brake 201, and a main motor 271 as a rotational drive source of the various drums and rollers. In addition to the above-mentioned sensors, the abnormality detecting means include other sensors, which are not described here.

Figure 24:
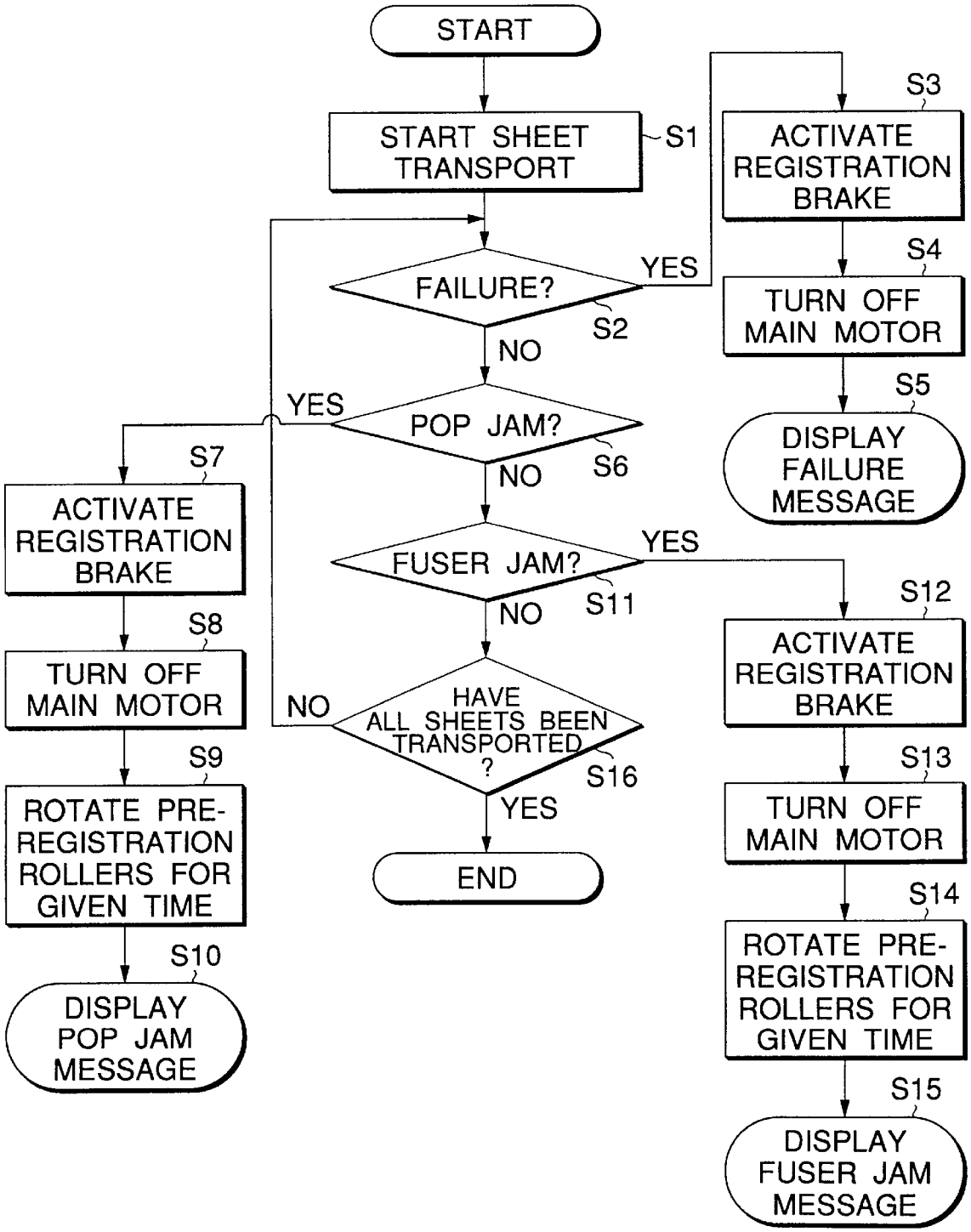
FIG. 24 is a control flowchart of the image forming apparatus of FIG. 22.

Next, the operation procedure of the image forming apparatus of the embodiment will be discussed with reference to a control flowchart of FIG. 24.

First, when sheet transport is started at step S1, whether a failure has occurred is judged according to the failure judgement software at step S2.

If a failure in, for instance, the drive force transmission mechanism is detected by the failure judgement software, the control section 251 turns on the brake 201 to forcibly stop rotation of the registration roller 161 at step S3 and turns off the main motor 271 at step S4. The control section 251 then effects display indicating the occurrence of a failure on a panel screen of an operating section at step S5. Upon detection of so-called interlock opening when the cover of the apparatus is opened by error during sheet transport, similar steps to steps S3–S5 are also executed to secure safety of the operator.

On the other hand, if no failure is detected at step S2, the process goes to step S6, where it is judged based on an output signal of the POP jam sensor 241 whether a POP jam has occurred.

If a sheet supplied to the image recording section by rotation of the registration rollers 161 is wrapped around the photoreceptor drum 171 and the tip of the sheet is detected by the POP jam sensor 241, a detection signal is output to the control section 251. When receiving the detection signal, the control section 251 turns on the registration brake 201 to forcibly stop rotation of the registration rollers 161 at step S7 and turns off the main motor 271 at step S8. At this time, although the main motor 271 is stopped, the photoreceptor drum 171 tends to continue its rotation due to inertia, the registration rollers 161 are forcibly stopped to immediately stop the sheet transport, whereby the rotation of the photoreceptor drum 171 is stopped semiforcibly. Therefore, a sheet overrun can be prevented even at the occurrence of a POP jam. Thus, a sheet that has caused a POP jam can be stopped in a positional range where a user can easily remove it.

When a POP jam has occurred, if a jam sheet or the next sheet exists at a position where a guillotine jam will occur when the transfer unit 281 is drawn out, the pre-registration clutch 121*a* is operated to rotate the pre-registration rollers 121 for a predetermined time T, to thereby feed the jammed sheet or the next sheet to an area before the registration rollers 161 at step S9 (guillotine jam preventing measure). At this time, since the brake 201 reliably prevents rotation of the registration rollers 161, even if the next sheet is fed by rotation of the pre-registration rollers 121 as in the conventional case, the registration rollers 161 do not idle. Therefore, there does not occur an event that a sheet goes into the image recording section due to idle rotation of the pre-registration rollers 121. Thus, toner contamination and mechanical damage can be prevented reliably.

Thereafter, the control section 251 displays a POP jam occurrence message on the panel screen of the operating section at step S10.

If no POP jam is detected at step S6, the process goes to step S11, where it is judged based on an output signal of the fuser jam sensor 261 whether a fuser jam has jam has occurred.

When a fuser jam is detected by the fuser jam sensor 261, a detection signal is output to the control section 251. When receiving the detection signal, the control section 251 executes steps S12–S14 that are similar to steps S7–S9, and then displays a fuser jam occurrence message at step S15.

On the other hand, if no fuser jam is detected at step S11, the process goes to step S16, where it is judged whether all sheets have been transported. If the judgment result is negative, the process returns to step S2 to repeat the above steps. If the judgment result is affirmative, the process is finished.

As described above, when an abnormality such as a jam is sensed during sheet transport, the image forming apparatus of the embodiment immediately activates the registration brake 201 to forcibly stop rotation of the registration rollers 161. Therefore, sheet rushing into the cleaner etc. due to its overrun or sheet rushing into the image recording section due to idle rotation of the registration rollers 161 can be prevented reliably.

We have discussed the embodiment by taking a failure in the operation of the apparatus, a POP jam, and a fuser jam as examples of abnormalities that may occur during sheet transport. The invention is not limited to such a case. For example, when an abnormality occurs because a sheet does not arrive at the pre-registration sensor 111 or the registration sensor 151 at predetermined timing, the registration brake 201 may also be activated to forcibly stop rotation of the registration rollers 161 in the same manner as described above, whereby various problems associated with abnormalities during sheet transport can be solved.

By the way, with an image forming apparatus for processing a plurality of sheets at high speed, it is essential to set a gap between the preceding and following sheets (sheet-to-sheet gap) as narrow as possible. In the conventional image forming apparatuses, just after the preceding sheet exits the registration rollers 161, the registration clutch 191 is operated to stop rotation of the registration rollers 161. In this case, however, a time lag occurs between the instant at which the registration clutch 191 is operated to disengage the drive source and the instant at which rotation of the registration rollers 161 completely stops. If a following sheet arrives at the registration rollers 161 before the registration rollers 161 completely stop, a shift in the sheet tip position is caused due to engagement with the registration rollers 161 and the sheet cannot be supplied to the image recording section at proper timing. Therefore, with the conventional apparatuses, allowance for the time required until the registration rollers 161 completely stop by operation of the registration clutch 191 must be made to set a sheet-to-sheet gap a little too large.

To cope with such a problem, the image forming apparatus of this embodiment effectively utilizes the registration brake 201 (brake means) in the following control mode in addition to the mode for dealing with occurrence of an abnormality during sheet transport. A preceding sheet arrives at the registration rollers 161 as the pre-registration rollers 121 rotate, and is temporarily stopped for skew correction and timing adjustment at the registration roller 161, then is supplied to the image recording section by rotation of the registration rollers 161.

At the time, the rear end position of the preceding sheet is detected by the registration sensor 151. At this time, the control section 251 recognizes that the preceding sheet exited the registration rollers 161 in a predetermined time after the registration sensor 151 detected the rear end position of the sheet from the relationship between the sheet transport speed of the registration rollers 161 and the distance between the registration sensor 151 and the registration rollers 161. Further, immediately after recognizing that the sheet exited the registration rollers 161, the control section 251 activates the registration brake 201 to forcibly stop rotation of the registration rollers 161 and, at the same time, disengages the registration clutch 191 to stop the rotational driving of the registration rollers 161 by the motor etc.

Thus, even if the following sheet arrives at the registration rollers 161 as soon as the preceding sheet exits the registration rollers 161, rotation of the registration rollers 161 is already stopped reliably by the registration brake 201 at the point in time, so that the sheet-to-sheet gap can be set narrower than was previously possible without incurring any problem such as a timing shift to the image recording section, and a large PPM value is enabled.

As we have discussed, according to the first aspect of the invention, the engagement member disposed downstream in the transport direction of a recording sheet from the toner image transfer position, the sheet retainer member disposed upstream, and the sheet guide member are drawn out to the front side of the axial direction of the image carrying body, whereby the recording sheet causing a POP jam to occur is taken out to the outside of the image forming apparatus together with the sheet retainer member, etc. Thus, a POP jam can be reliably removed through a simply structure and by easy operation and a risk for the user to dip his or her hand into the system frame for jam removal can be avoided.

According to the second aspect of the invention, turn of the engagement member is always limited in any state other than the state in which the unit is completely housed in the apparatus main body, and an accident such that the members in the unit come in sliding contact with the members in the apparatus main body and are broken does not occur.

The engagement member is guided into the through-hole by the guide part regardless of where the engagement piece exists between the stopper and the movable stopper. Thus, when inserting the unit into the apparatus main body, the user need not align the engagement member and can easily insert the unit.

Further, according to the third aspect of the invention, when an abnormality is detected during sheet transport, rotation of the registration roller is forcibly stopped by the brake means. Therefore, for example, when a POP jam occurs, sheet rushing into the cleaner etc. due to an overrun can be reliably prevented. Also in the case of feeding a sheet to prevent a guillotine jam, sheet rushing into the image recording section due to idle rotation of the registration roller can be prevented reliably. Thus, an image forming apparatus can be provided which can solve various problems associated with the occurrence of an abnormality during sheet transport, and which is excellent in jam removal performance.

What is claimed is:

1. An image forming apparatus comprising:

a sheet transport channel including a registration roller for supplying a sheet that is fed from a tray to an image recording section at predetermined timing;

brake means for forcibly stopping rotation of the registration roller;

means for sensing occurrence of an abnormality in the paper transport channel during transport of the sheet; and control means for activating the brake means when the sensing means has detected the abnormality.

2. The image forming apparatus as claimed in claim 1, wherein the control means activates the brake means immediately after the sheet has passed the registration roller.

3. The image forming apparatus as claimed in claim 1, wherein the control means activates the brake means when the sheet is nipped by the registration roller.

* * * * *